US011413863B2

(12) United States Patent
Fukuzawa et al.

(10) Patent No.: US 11,413,863 B2
(45) Date of Patent: Aug. 16, 2022

(54) LIQUID EJECTING HEAD AND LIQUID EJECTING APPARATUS

(71) Applicant: SEIKO EPSON CORPORATION, Tokyo (JP)

(72) Inventors: Yuma Fukuzawa, Matsumoto (JP); Kazuaki Uchida, Fujimi-Machi (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/721,201

(22) Filed: Dec. 19, 2019

(65) Prior Publication Data

US 2020/0198344 A1 Jun. 25, 2020

(30) Foreign Application Priority Data

Dec. 21, 2018 (JP) ..... JP2018-239220

(51) Int. Cl.
*B41J 2/14* (2006.01)

(52) U.S. Cl.
CPC ..... *B41J 2/1404* (2013.01); *B41J 2/14145* (2013.01); *B41J 2002/14338* (2013.01)

(58) Field of Classification Search
CPC ..... B41J 2202/12
See application file for complete search history.

(56) References Cited

U.S. PATENT DOCUMENTS 5,790,152 A 8/1998 Harrington
9,694,582 B1 * 7/2017 Stephens ..... B41J 2/14201
10,214,023 B1 * 2/2019 Stephens ..... B41J 2/14
2008/0316278 A1 12/2008 Van den Bergen
2010/0214380 A1 * 8/2010 Essen ..... B41J 2/14233 347/85
2010/0238238 A1 9/2010 Yamamoto
2012/0176450 A1 7/2012 Akahane et al.
2018/0264837 A1 * 9/2018 Matsuo ..... B41J 2/16
2019/0291447 A1 9/2019 Sugiura
2020/0207091 A1 * 7/2020 Ikeuchi ..... B41J 2/155
2020/0338891 A1 * 10/2020 Tanaka ..... B41J 2/14201

FOREIGN PATENT DOCUMENTS

CN 108656747 10/2018
JP 2012143948 8/2012
WO WO-2019130532 A1 * 7/2019 ..... B41J 2/155

* cited by examiner

*Primary Examiner* — Shelby L Fidler
(74) *Attorney, Agent, or Firm* — Workman Nydegger

(57) ABSTRACT

A liquid ejecting head includes first and second individual flow paths arranged side by side along a first direction; a first nozzle communicating with the first individual flow path; a second nozzle communicating with the second individual flow path; and a common liquid chamber coupled to the first and second individual flow paths. The first and second nozzles have openings in a nozzle surface having a second direction as a normal direction. The first individual flow path has a first upstream communication path extending between the first nozzle and the common liquid chamber along the second direction. The second individual flow path has a second upstream communication path extending between the second nozzle and the common liquid chamber along the second direction. The first upstream communication path and the second upstream communication path have parts which do not overlap each other when seen along the first direction.

7 Claims, 10 Drawing Sheets

LIQUID EJECTING HEAD AND LIQUID EJECTING APPARATUS

The present application is based on, and claims priority from JP Application Serial Number 2018-239220, filed Dec. 21, 2018, the disclosure of which is hereby incorporated by reference herein in its entirety.

BACKGROUND

1. Technical Field

The present disclosure relates to a liquid ejecting head and a liquid ejecting apparatus which eject a liquid from a nozzle, particularly, to an ink jet type recording head and an ink jet type recording apparatus which discharge an ink as a liquid.

2. Related Art

As a liquid ejecting head that ejects a liquid, there is known an ink jet type recording head that performs printing by discharging an ink as a liquid onto a printed medium.

The ink jet type recording head includes an individual flow path having a pressure chamber that communicates with a nozzle, a common liquid chamber that communicates in common with a plurality of the individual flow paths, and an energy generating element such as a piezoelectric actuator that induces a change in the pressure of the ink in the pressure chamber. If the energy generating element induces a change in the pressure of the ink in the pressure chamber, ink droplets are discharged from the nozzle.

In the ink jet type recording head described above, if air bubbles stay in the pressure chamber, the air bubbles absorb the pressure change induced by the energy generating element, and thus it is not possible to normally discharge the ink droplets from the nozzle.

For this reason, there is proposed an ink jet type recording head having a configuration where a first common liquid chamber and a second common liquid chamber are provided as common liquid chambers which are in common with individual flow paths, and an ink flows from the first common liquid chamber to the second common liquid chamber through the individual flow paths, namely, so-called circulation is performed (for example, refer to JP-A-2012-143948).

In the ink jet type recording head described above, there is a demand for reducing a flow path resistance or an inertance without lowering the resolution of the nozzle, but if the cross-sectional area of the flow path is enlarged, there is a problem such as a size increase of a flow path substrate, a reduction in the rigidity of a partition wall between the flow paths, or the occurrence of cross talk.

The above-mentioned problem exists not only in the ink jet type recording head, similarly but also in liquid ejecting heads that eject liquids other than an ink.

SUMMARY

An advantage of some aspects of the present disclosure provides a liquid ejecting head and a liquid ejecting apparatus which prevents the occurrence of cross talk by preventing a size increase of a flow path substrate, and a reduction in the rigidity of a partition wall between flow paths.

According to an aspect of the present disclosure, there is provided a liquid ejecting head including first and second individual flow paths arranged side by side along a first direction; a first nozzle communicating with the first individual flow path; a second nozzle communicating with the second individual flow path; a first common liquid chamber coupled to one ends of the first and second individual flow paths; and a second common liquid chamber coupled to the other ends of the first and second individual flow paths, in which the first and second nozzles have openings in a nozzle surface having a second direction as a normal direction, in which the first individual flow path has a first upstream communication path extending between the first nozzle and the first common liquid chamber along the second direction, in which the second individual flow path has a second upstream communication path extending between the second nozzle and the first common liquid chamber along the second direction, and in which the first upstream communication path and the second upstream communication path have parts which do not overlap each other when seen along the first direction.

In addition, according to another aspect, there is provided a liquid ejecting apparatus including the liquid ejecting head described in the aspect.

DESCRIPTION OF EXEMPLARY EMBODIMENTS

Hereinafter, the present disclosure will be described in detail based on embodiments.

Embodiment 1

Figure 1:
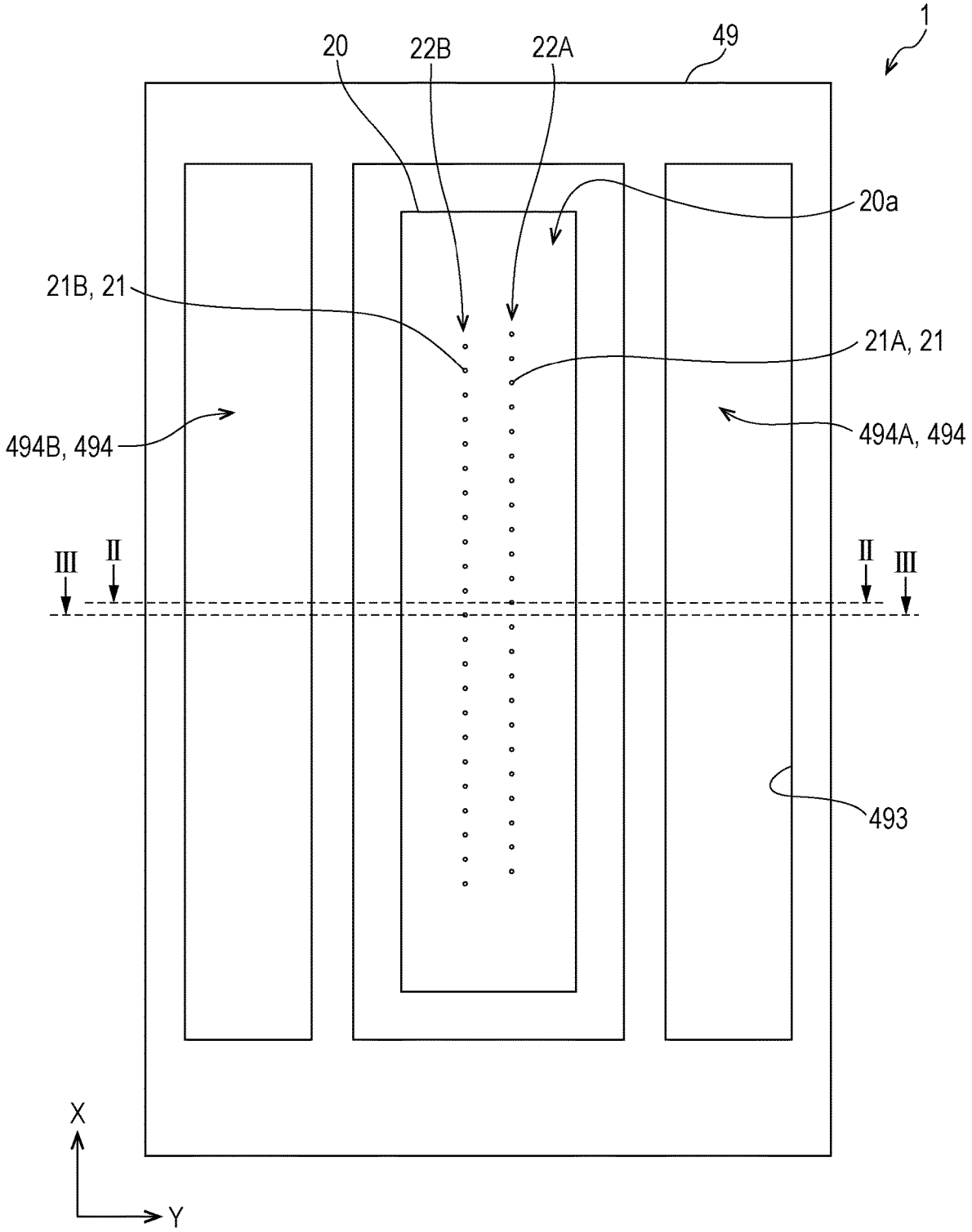
FIG. 1 is a plan view of a recording head according to Embodiment 1 of the present disclosure.
Figure 2:
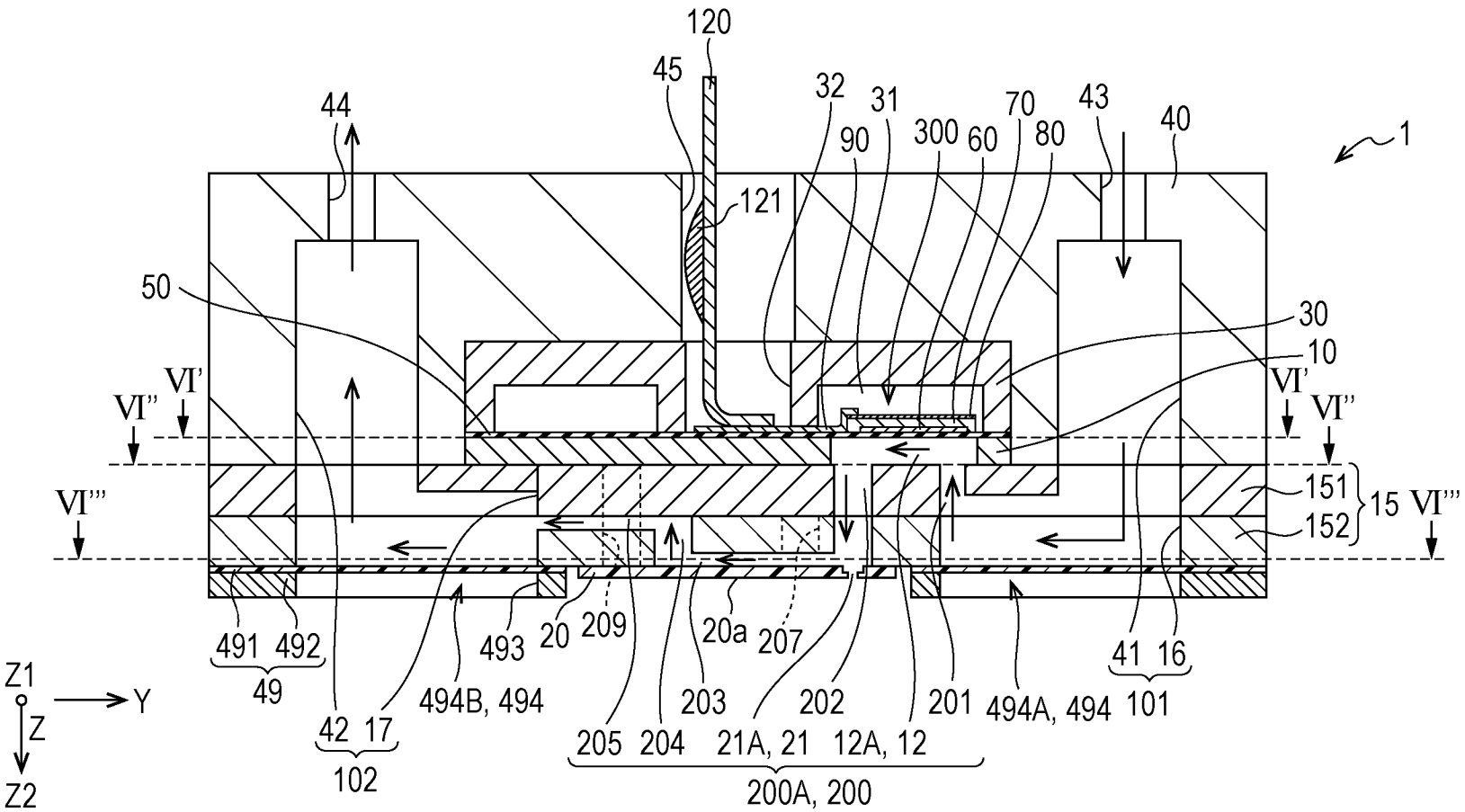
FIG. 2 is a cross-sectional view of the recording head according to Embodiment 1 of the present disclosure.
Figure 3:
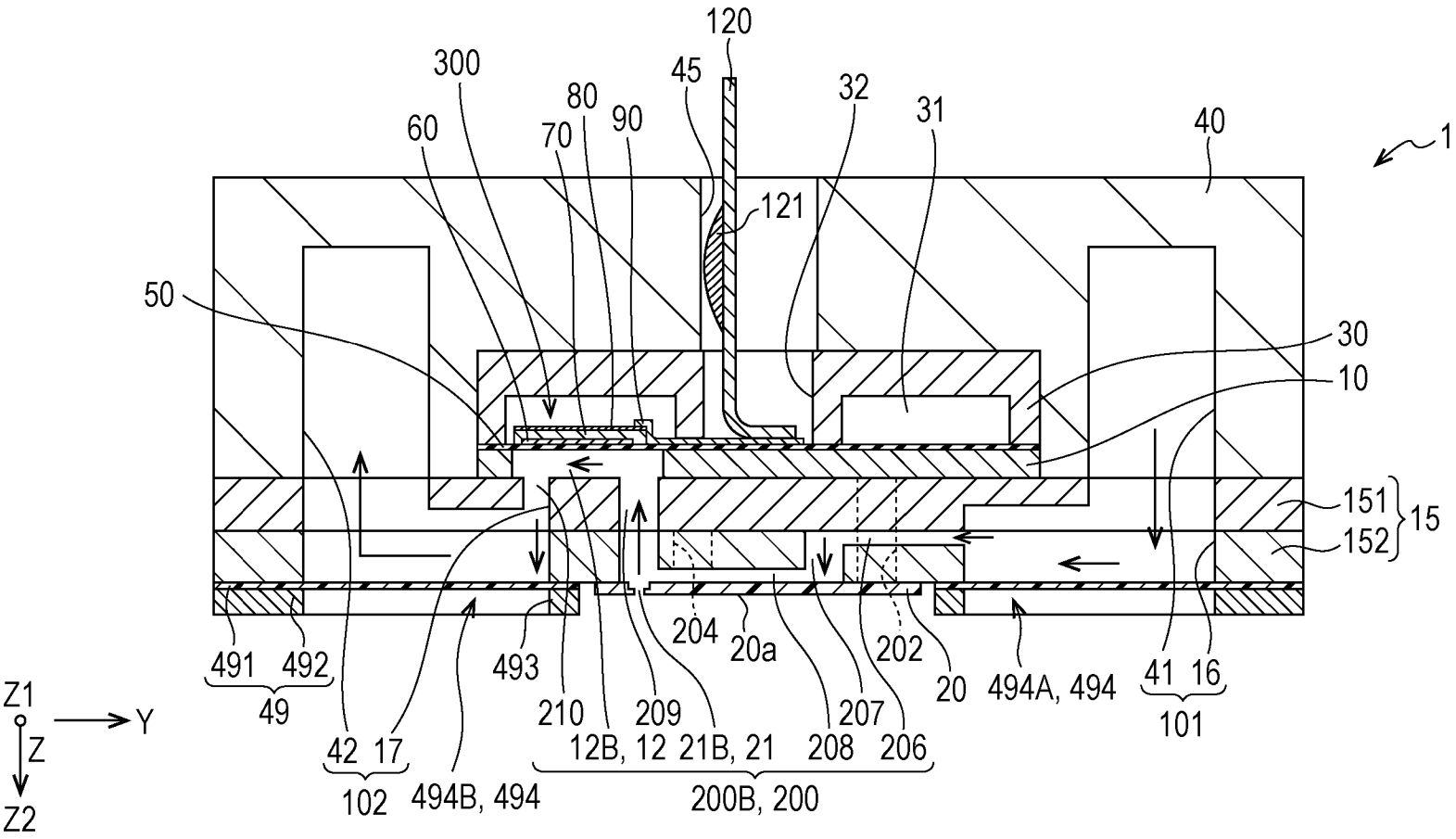
FIG. 3 is a cross-sectional view of the recording head according to Embodiment 1 of the present disclosure.
Figure 4:
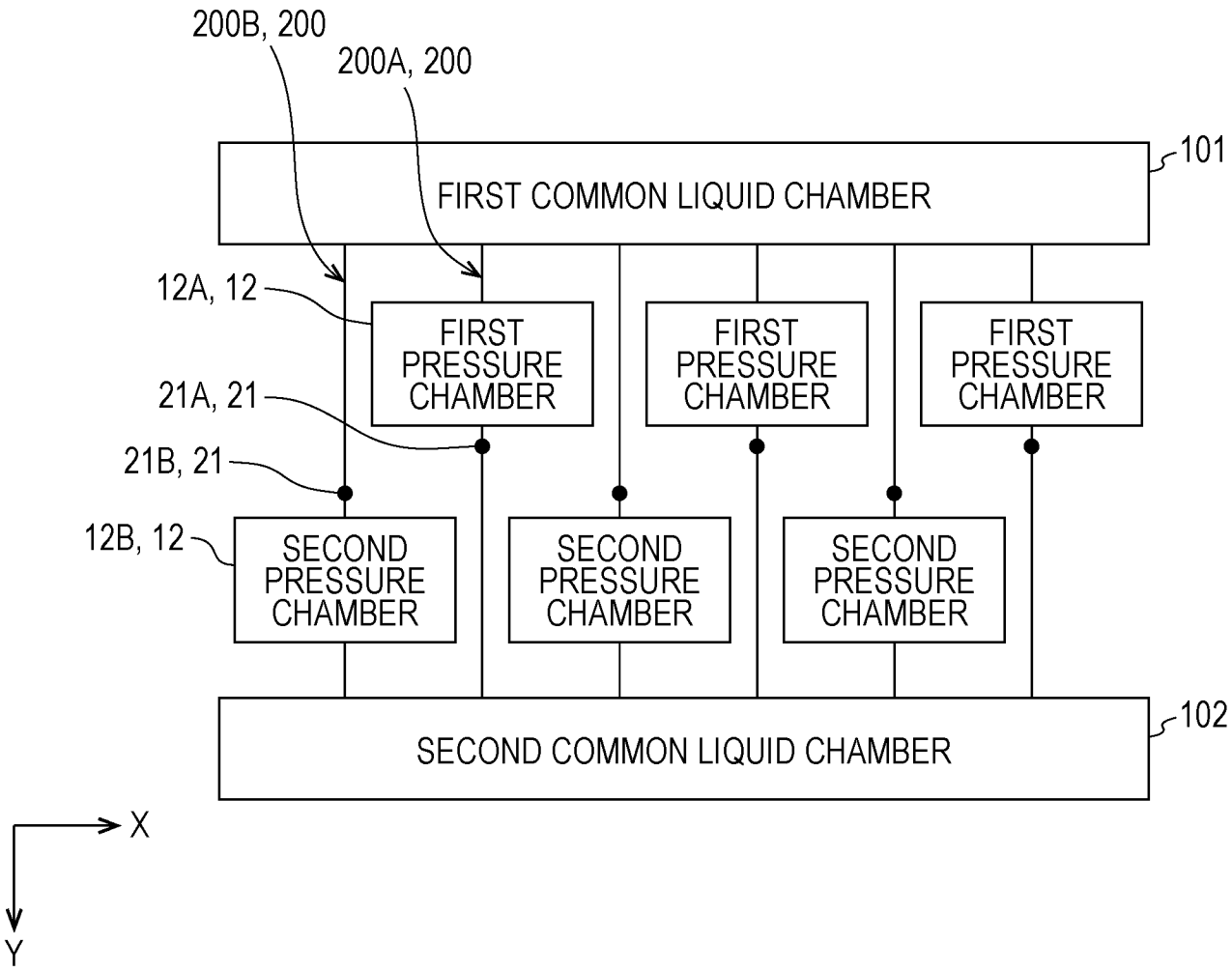
FIG. 4 is a diagram schematically illustrating flow paths according to Embodiment 1 of the present disclosure.
Figure 5:
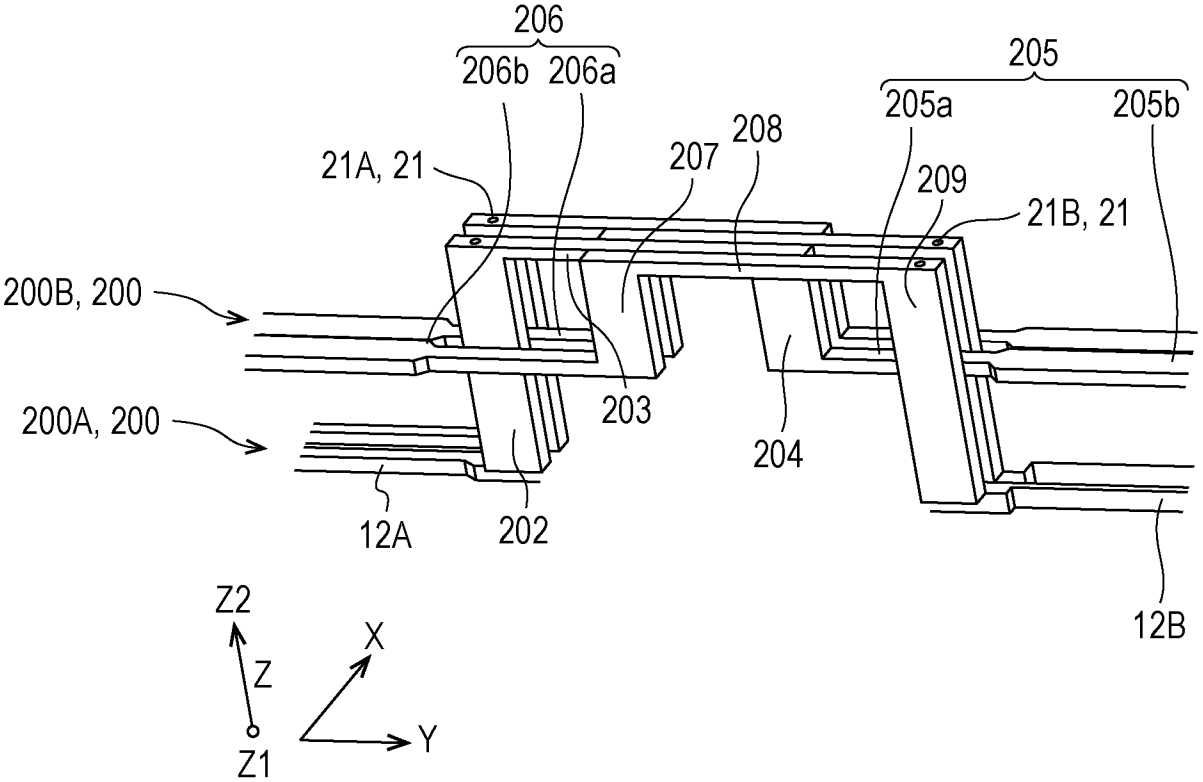
FIG. 5 is a perspective view of the flow paths according to Embodiment 1 of the present disclosure.
Figure 6:
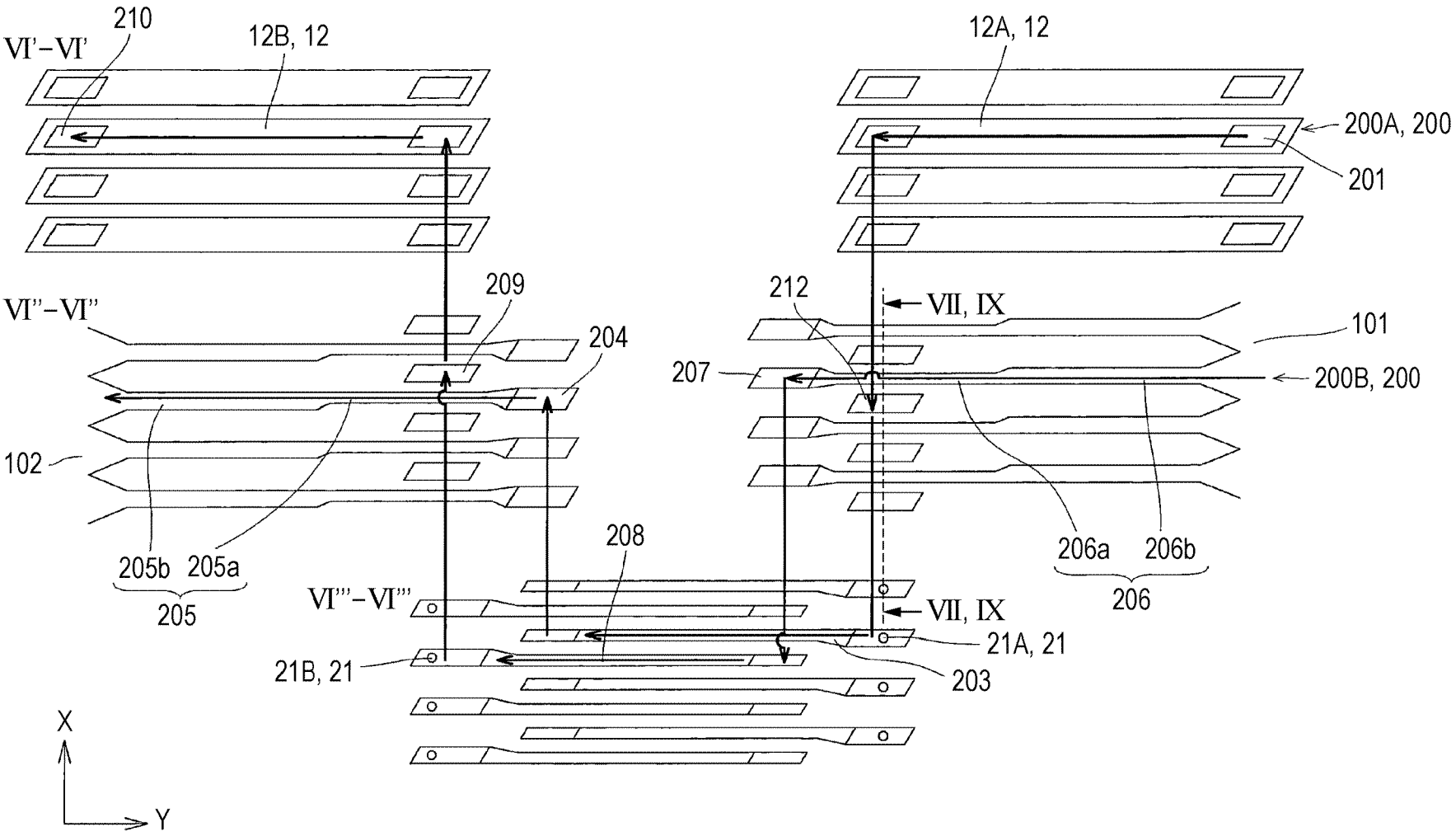
FIG. 6 is a cross-sectional view of a main part of the recording head according to Embodiment 1 of the present disclosure.
Figure 7:
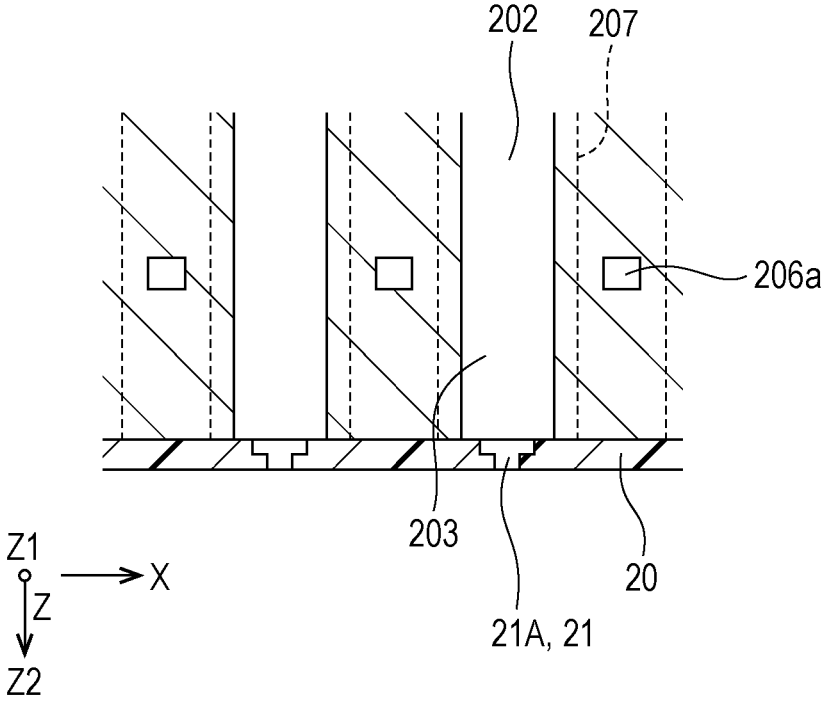
FIG. 7 is a cross-sectional view of a main part of the recording head according to Embodiment 1 of the present disclosure.

An ink jet type recording head of an embodiment which is one example of a liquid ejecting head will be described with reference to FIGS. 1 to 7. Incidentally, FIG. 1 is a plan view of the ink jet type recording head which is one example of a liquid ejecting head according to Embodiment 1 of the present disclosure, which is seen from a nozzle surface side. FIG. 2 is a cross-sectional view taken along a line II-II in FIG. 1. FIG. 3 is a cross-sectional view taken along a line III-III in FIG. 1. FIG. 4 is a diagram schematically illustrating flow paths. FIG. 5 is a perspective view of the flow paths seen from a Z2 side. FIG. 6 is a cross-sectional view of a main part of the recording head, a cross-sectional view taken along a line VI'-VI' in FIG. 2, a cross-sectional view taken along a line VI"-VI" in FIG. 2, and a cross-sectional view taken along a line VI'''-VI''' in FIG. 2. FIG. 7 is a cross-sectional view taken along a line VII-VII in FIG. 6.

An ink jet type recording head 1 (hereinafter, referred to simply also as a recording head 1) of the embodiment which is one example of a liquid ejecting head includes, as illustrated, a plurality of members as a flow path substrate such as a flow path formation substrate 10, a communication plate 15, a nozzle plate 20, a protection substrate 30, a case member 40, and a compliance substrate 49.

The flow path formation substrate 10 is made of a single crystal silicon substrate, and a vibrating plate 50 is formed on one surface thereof. The vibrating plate 50 may be a single layer or a lamination layer selected from a silicon dioxide layer or a zirconium oxide layer.

The flow path formation substrate 10 is provided with a plurality of pressure chambers 12 which form individual flow paths 200 and are partitioned off by a plurality of partition walls. The plurality of pressure chambers 12 are arranged side by side at a predetermined pitch along a direction where a plurality of nozzles 21 discharging an ink are arranged side by side. Hereinafter, the direction is referred to as a side by side arrangement direction of the nozzles 21, a side by side arrangement direction of the pressure chambers 12, or a first direction X. In addition, the flow path formation substrate 10 is provided with a plurality of rows of the pressure chambers 12 that are arranged side by side in the first direction X, and in the embodiment, two rows are provided. A row arrangement direction where the plurality of rows of the pressure chambers 12 are provided is referred to, hereinafter, as a second direction Y. Incidentally, in the embodiment, a portion between the pressure chambers 12 which are arranged side by side in the first direction X of the flow path formation substrate 10 is referred to as a partition wall. The partition wall is formed along the second direction Y. Namely, the partition wall refers to a portion that overlaps the pressure chamber 12 in the second direction Y of the flow path formation substrate 10.

In addition, in the embodiment, in two rows of the pressure chambers 12, the pressure chamber 12 in one row is referred to as a first pressure chamber 12A, and the pressure chamber 12 in the other row is referred to as a second pressure chamber 12B. The first pressure chamber 12A and the second pressure chamber 12B are disposed at positions which do not overlap each other in a plan view from the first direction X. In addition, the first pressure chambers 12A and the second pressure chambers 12B are disposed in a so-called staggered pattern where the first pressure chambers 12A deviate from the second pressure chamber 12B in the first direction X. In the embodiment, the row in which the first pressure chambers 12A are arranged side by side in the first direction X, and the row in which the second pressure chambers 12B are arranged side by side in the first direction X are disposed at positions which deviate by half a pitch from each other in the first direction X. Incidentally, part of the first pressure chamber 12A and part of the second pressure chamber 12B may be disposed at positions which overlap each other in the plan view from the first direction X.

In addition, in the embodiment, a direction orthogonal to both of the first direction X and the second direction Y is referred to as a third direction Z. A side close to the case member 40 with respect to the nozzle plate 20 (to be described in detail later) is referred to as a Z1 side, and a side close to the nozzle plate 20 with respect to the case member 40 is referred to as a Z2 side. Incidentally, the first direction X, the second direction Y, and the third direction Z are directions orthogonal to each other, but are not specifically limited, and may be directions intersecting each other at angles other than the orthogonal angle.

Incidentally, in the embodiment, the flow path formation substrate 10 is provided only with the pressure chamber 12, but may be provided with a flow path resistance application portion having a flow path cross-sectional area smaller than that of the pressure chamber 12 so as to apply a flow path resistance to the ink to be supplied to the pressure chamber 12.

The vibrating plate 50 is formed, as described above, on the Z1 side which is one surface side of the flow path formation substrate 10 described above in the third direction Z. A piezoelectric actuator 300 is formed by laminating a first electrode 60, a piezoelectric layer 70, and a second electrode 80 on the vibrating plate 50 by deposition and lithography. In the embodiment, the piezoelectric actuator 300 is an energy generating element that induces a change in the pressure of the ink in the pressure chamber 12. Herein, the piezoelectric actuator 300 is referred to also as a piezoelectric element, and refers to a portion containing the first electrode 60, the piezoelectric layer 70, and the second electrode 80. Generally, either one electrode of the piezoelectric actuator 300 is configured as a common electrode, and the other electrode and the piezoelectric layer 70 are formed for each of the pressure chambers 12 by patterning. In the embodiment, the first electrode 60 is formed as a common electrode of the piezoelectric actuator 300, and the second electrode 80 is formed as an individual electrode of the piezoelectric actuator 300, but even though the configuration becomes reversed for the reasons of drive circuits or wirings, there is no problem. Incidentally, in the example described above, the vibrating plate 50 and the first electrode 60 act as a vibrating plate. However, naturally, the present disclosure is not limited to the configuration, for example, the vibrating plate 50 may not be provided, and only the first electrode 60 may act as a vibrating plate. In addition, the piezoelectric actuator 300 may serve substantially as a vibrating plate.

In addition, lead electrodes 90 are coupled to the second electrodes 80 of the piezoelectric actuators 300 described above, and a voltage is selectively applied to the piezoelectric actuators 300 via the lead electrodes 90.

In addition, the protection substrate 30 is joined to a surface of the flow path formation substrate 10, on which the piezoelectric actuator 300 is provided.

A piezoelectric actuator holding portion 31 having a space not to obstruct the motion of the piezoelectric actuator 300 is provided in a region of the protection substrate 30, which faces the piezoelectric actuator 300. The piezoelectric actuator holding portion 31 may have a space not to obstruct the motion of the piezoelectric actuator 300, and the space may be sealed or may not be sealed. In addition, in the embodiment, the piezoelectric actuator holding portion 31 is independently provided for each row of a plurality of the piezoelectric actuators 300 that are arranged side by side in the first direction X. Namely, the piezoelectric actuator holding portion 31 is formed having a size to integrally cover a row of the plurality of piezoelectric actuators 300 that are arranged side by side in the first direction X. Naturally, the piezoelectric actuator holding portion 31 is not specifically limited to the configuration, and may individually cover the piezoelectric actuator 300, or may cover each group formed of two or more piezoelectric actuators 300 that are arranged side by side in the first direction X.

Preferably, a material, for example, a glass or ceramic material having substantially the same coefficient of thermal expansion as that of the material of the flow path formation substrate 10 is used as the material of the protection substrate 30 described above. In the embodiment, the protection substrate 30 is formed of a single crystal silicon substrate which is the same material as that of the flow path formation substrate 10.

In addition, the protection substrate 30 is provided with a through hole 32 penetrating the protection substrate 30 in the third direction Z. The vicinity of an end portion of the lead electrode 90 leading out from each of the piezoelectric actuators 300 is provided extending so as to be exposed in the through hole 32, and is electrically coupled to a flexible cable 120 in the through hole 32. The flexible cable 120 is a wiring substrate having flexibility, and in the embodiment, a drive circuit 121 which is a semiconductor element is mounted thereon. Incidentally, the lead electrode 90 may be electrically coupled to the drive circuit 121 without via the flexible cable 120. In addition, the protection substrate 30 may be provided with a flow path.

In addition, the case member 40 is fixed to a Z1 side of the protection substrate 30. The case member 40 is provided to be joined to a surface side of the protection substrate 30, which is opposite to the flow path formation substrate 10, and joined also to the communication plate 15 (to be described later).

The case member 40 described above is provided with a first liquid chamber portion 41 forming part of a first common liquid chamber 101, and a second liquid chamber portion 42 forming part of a second common liquid chamber 102. The first liquid chamber portion 41 and the second liquid chamber portion 42 are provided on both sides in the second direction Y, respectively, where two rows of the pressure chambers 12 are interposed therebetween.

Each of the first liquid chamber portion 41 and the second liquid chamber portion 42 has a recessed shape that opens in a Z2 side surface of the case member 40, and is continuously provided over the plurality of pressure chambers 12 that are arranged side by side in the first direction X.

In addition, the case member 40 is provided with an inlet port 43 which communicates with the first liquid chamber portion 41 and through which the ink flows into the first liquid chamber portion 41, and an outlet port 44 which communicates with the second liquid chamber portion 42 and through which the ink flows out from the second liquid chamber portion 42.

Furthermore, the case member 40 is provided with a coupling port 45 which communicates with the through hole 32 of the protection substrate 30, and into which the flexible cable 120 is inserted.

On the one hand, the communication plate 15, the nozzle plate 20, and the compliance substrate 49 are provided on the Z2 side that is a surface side of the flow path formation substrate 10, which is opposite to the protection substrate 30.

In the embodiment, the communication plate 15 is configured such that a first communication plate 151 and a second communication plate 152 are laminated on top of each other in the third direction Z. The first communication plate 151 is provided close to the flow path formation substrate 10, namely, on the Z1 side in the third direction Z. The second communication plate 152 is provided close to the nozzle plate 20, namely, on the Z2 side in the third direction Z.

The first communication plate 151 and the second communication plate 152 forming the communication plate 15 described above can be manufactured of a metallic material such as stainless steel, a glass material, or a ceramic material, or the like. Incidentally, preferably, a material having substantially the same coefficient of thermal expansion as that of the material of the flow path formation substrate 10 is used as the material of the communication plate 15. In the embodiment, the communication plate 15 is formed of a single crystal silicon substrate which is the same material as that of the flow path formation substrate 10.

The communication plate 15 is, as will be described in detail later, provided with a first communication portion 16 and a second communication portion 17 which form part of the first common liquid chamber 101 and part of the second common liquid chamber 102, respectively. In addition, the communication plate 15 is, as will be described in detail later, provided with a flow path through which the first common liquid chamber 101 communicates with the pressure chamber 12, a flow path through which the pressure chamber 12 communicates with the nozzle 21, and a flow path through which the nozzle 21 communicates with the second common liquid chamber 102. The flow paths provided in the communication plate 15 form part of the individual flow path 200.

The nozzle plate 20 is provided with the plurality of nozzles 21 which communicate with the outside and communicate with the pressure chambers 12. In the embodiment, as illustrated in FIG. 1, the plurality of nozzles 21 are disposed in a so-called staggered pattern where a first nozzle row 22A in which the plurality of nozzles 21 are arranged side by side in the first direction X and a second nozzle row 22B in which the plurality of nozzles 21 are arranged side by side in the first direction X are arranged side by side in the second direction Y, and the first nozzle row 22A and the second nozzle row 22B deviate from each other in the first direction X so as not to be at the same positions in the second direction Y. In the embodiment, the nozzle 21 of the first nozzle row 22A is referred to as a first nozzle 21A, and the nozzle 21 of the second nozzle row 22B is referred to as a second nozzle 21B. The first nozzle 21A of the first nozzle row 22A communicates with the first pressure chamber 12A. In addition, the second nozzle 21B of the second nozzle row 22B communicates with the second pressure chamber 12B. Incidentally, the first nozzle row 22A and the second nozzle row 22B may line up on a straight line in the first direction X.

In addition, the communication plate 15 has the first communication portion 16 forming part of the first common liquid chamber 101, and the second communication portion 17 forming part of the second common liquid chamber 102.

The first communication portion 16 is provided at a position to overlap the first liquid chamber portion 41 of the case member 40 in the third direction Z, and is provided to be open in both of a Z1 side surface and a Z2 side surface of the communication plate 15. The first communication portion 16 communicates with the first liquid chamber portion 41 on the Z1 side to form the first common liquid chamber 101. Namely, the first common liquid chamber 101 is formed of the first liquid chamber portion 41 of the case member 40 and the first communication portion 16 of the communication plate 15. In addition, the first communication portion 16 is provided extending in the second direction Y to a position on the Z2 side to overlap the pressure chamber 12 in the third direction Z. Incidentally, the communication plate 15 may not be provided with the first communication portion 16, and the first common liquid chamber 101 may be formed of the first liquid chamber portion 41 of the case member 40.

The second communication portion 17 is provided at a position to overlap the second liquid chamber portion 42 of the case member 40 in the third direction Z, and is provided to be open in both of the Z1 side surface and the Z2 side surface of the communication plate 15. The second communication portion 17 communicates with the second liquid chamber portion 42 on the Z1 side to form the second common liquid chamber 102. Namely, the second common liquid chamber 102 is formed of the second liquid chamber portion 42 of the case member 40 and the second communication portion 17 of the communication plate 15. In addition, the second communication portion 17 is provided extending in the second direction Y to a position on the Z2 side to overlap the pressure chamber 12 in the third direction Z. Incidentally, the communication plate 15 may not be provided with the second communication portion 17, and the second common liquid chamber 102 may be formed of the second liquid chamber portion 42 of the case member 40.

The compliance substrate 49 having a compliance portion 494 is provided on the Z2 side surface of the communication plate 15, in which the first communication portion 16 and the second communication portion 17 open. The compliance substrate 49 seals openings of the first common liquid chamber 101 and the second common liquid chamber 102, which are close to a nozzle surface 20*a*.

In the embodiment, the compliance substrate 49 described above includes a sealing film 491 made of a thin film having flexibility, and a fixation substrate 492 made of a hard material such as metal. Since each of regions of the fixation substrate 492 which face the first common liquid chamber 101 and the second common liquid chamber 102 becomes an opening portion 493 formed by completely removing the regions in a thickness direction, part of a wall surface of each of the first common liquid chamber 101 and the second common liquid chamber 102 becomes the compliance portion 494 which is a flexible portion sealed only with the sealing film 491 having flexibility. In the embodiment, the compliance portion 494 provided in the first common liquid chamber 101 is referred to as a first compliance portion 494A, and the compliance portion 494 provided in the second common liquid chamber 102 is referred to as a second compliance portion 494B. As described above, if the compliance portion 494 is provided in part of the wall surface of each of the first common liquid chamber 101 and the second common liquid chamber 102, the compliance portion 494 is capable of, by being deformed, absorbing a fluctuation in the pressure of the ink in the first common liquid chamber 101 and the second common liquid chamber 102.

In addition, in the embodiment, since the first common liquid chamber 101 and the second common liquid chamber 102 are provided so as to open on the Z2 side on which the nozzle 21 opens, the nozzle plate 20 and the compliance portion 494 are disposed on the Z2 side which is the same side with respect to the individual flow path 200 having the pressure chamber 12 and the nozzle 21 in the third direction Z which is a normal direction of the nozzle surface 20*a*. As described above, if the compliance portion 494 is disposed on the same side as the nozzle 21 with respect to the individual flow path 200, it is possible to provide the compliance portion 494 in a region where the nozzle 21 is not provided, and it is possible to provide the compliance portion 494 having a relatively wide area. In addition, if the compliance portion 494 and the nozzle 21 are disposed on the same side with respect to the individual flow path 200, the compliance portion 494 is disposed at a position close to the individual flow path 200, and thus the compliance portion 494 is capable of effectively absorbing a fluctuation in the pressure of the ink in the individual flow path 200.

In addition, two compliance portions 494 of the embodiment are provided, as illustrated in FIG. 1, in one compliance substrate 49. Naturally, the compliance substrate 49 is not limited to the configuration, and the compliance substrate 49 may be independently provided for each of the compliance portions 494.

In addition, the flow path formation substrate 10, the communication plate 15, the nozzle plate 20, the compliance substrate 49, and the like which form the flow path substrate are provided with a plurality of the individual flow paths 200 which communicate with the first common liquid chamber 101 and the second common liquid chamber 102 and deliver the ink of the first common liquid chamber 101 to the second common liquid chamber 102. Herein, the individual flow paths 200 of the embodiment communicate with the first common liquid chamber 101 and the second common liquid chamber 102, are provided for each of the nozzles 21, and contain the nozzle 21. As described above, three individual flow paths 200 adjacent to each other in the first direction X which is the side by side arrangement direction of the nozzles 21 are provided to communicate with the first common liquid chamber 101 and the second common liquid chamber 102. Namely, the plurality of individual flow paths 200 provided for each of the nozzles 21 are provided to communicate only with the first common liquid chamber 101 and the second common liquid chamber 102. The plurality of individual flow paths 200 do not communicate with parts other than the first common liquid chamber 101 and the second common liquid chamber 102. Namely, in the embodiment, flow paths provided with one nozzle 21 and one pressure chamber 12 are referred to as the individual flow path 200, and the individual flow paths 200 are provided to communicate only with the first common liquid chamber 101 and the second common liquid chamber 102.

In addition, in the embodiment, in the individual flow path 200, flow paths closer to the first common liquid chamber 101 than the nozzle 21 are referred to as upstream flow paths, and flow paths closer to the second common liquid chamber 102 than the nozzle 21 of the individual flow path 200 are referred to as downstream flow paths.

Furthermore, in the embodiment, the plurality of individual flow paths 200 arranged side by side in the first direction X include a first individual flow path 200A having the first nozzle 21A, and a second individual flow path 200B having the second nozzle 21B. The first individual flow paths 200A and the second individual flow paths 200B are alternately disposed in the first direction X.

As illustrated in FIG. 2, the first individual flow path 200A includes a first flow path 201; the first pressure chamber 12A; a second flow path 202; the first nozzle 21A; a third flow path 203; a fourth flow path 204; and a fifth flow path 205.

The first flow path 201 is a flow path through which the first pressure chamber 12A communicates with the first common liquid chamber 101. The first flow path 201 is provided to penetrate the first communication plate 151 in the third direction Z such that one end of the first flow path 201 on the Z2 side communicates with the first communication portion 16 forming the first common liquid chamber 101 and the other end on the Z1 side communicates with one end of the first pressure chamber 12A in the second direction Y.

The first pressure chamber 12A is provided, as described above, in the flow path formation substrate 10. A Z1 side opening of the first pressure chamber 12A is sealed with the vibrating plate 50, and part of a Z2 side opening of the first pressure chamber 12A is covered with the communication plate 15. The first pressure chamber 12A described above is formed with a first resolution in a direction where the flow paths line up, namely, in the first direction X. Namely, a flow path provided between the flow path formation substrate 10 which is a first flow path substrate and the communication plate 15 which is a second flow path substrate is the pressure chamber 12. In addition, since the first pressure chamber 12A and the second pressure chamber 12B are disposed at different positions in the second direction Y, the first resolution is the resolution of each of the first pressure chamber 12A and the second pressure chamber 12B. In addition, the first resolution is a pitch of the flow paths in the first direction X which is the direction where the flow paths line up.

The second flow path 202 is a flow path through which the first pressure chamber 12A communicates with the first nozzle 21A. The second flow path 202 is provided to penetrate the communication plate 15 in the third direction Z such that one end of the second flow path 202 on the Z1 side communicates with the other end of the first pressure chamber 12A in the second direction Y, and the other end on the Z2 side communicates with the first nozzle 21A provided in the nozzle plate 20. Namely, the second flow path 202 is provided between from the nozzle 21 to the first common liquid chamber 101 while extending in the third direction Z which is the normal direction of the nozzle surface 20*a*. The second flow path 202 is equivalent to an upstream communication path described in the aspect.

The first nozzle 21A is provided to communicate with the other end of the second flow path 202 on the Z2 side, and open in the nozzle surface 20*a* of the nozzle plate 20 on the Z2 side to communicate with the outside.

The third flow path 203 is provided between the second communication plate 152 and the nozzle plate 20 while extending along the second direction Y in an in-plane direction of the nozzle surface 20*a* so as for one end of the third flow path 203 to communicate with the second flow path 202. The third flow path 203 is formed by providing a recessed portion in the second communication plate 152 and covering an opening of the recessed portion with the nozzle plate 20. Incidentally, the third flow path 203 is not specifically limited to the method, and may be formed by providing a recessed portion in the nozzle plate 20 and covering the recessed portion with the second communication plate 152, or may be formed by providing recessed portions in both of the second communication plate 152 and the nozzle plate 20, respectively. The third flow path 203 forms part of a flow path provided between the communication plate 15 that is the second flow path substrate and the nozzle plate 20 that is a third flow path substrate, which are described in the aspect.

The fourth flow path 204 is provided such that one end of the fourth flow path 204 on the Z2 side communicates with the third flow path 203 and the fourth flow path 204 penetrates the second communication plate 152 in the third direction Z. Namely, the fourth flow path 204 is provided between from the nozzle 21 to the second common liquid chamber 102 while extending in the third direction Z which is the normal direction of the nozzle surface 20*a*. The fourth flow path 204 is equivalent to a downstream communication path described in the aspect.

The fifth flow path 205 is provided between the first communication plate 151 and the second communication plate 152 while extending along the second direction Y in the in-plane direction of the nozzle surface 20*a* such that one end of the fifth flow path 205 communicates with the fourth flow path 204 and the other end communicates with the second common liquid chamber 102. The fifth flow path 205 of the embodiment is formed by providing a recessed portion in the second communication plate 152 and covering the recessed portion with the first communication plate 151. Naturally, the fifth flow path 205 may be formed by providing a recessed portion in the first communication plate 151 and covering the recessed portion with the second communication plate 152, or may be formed by providing recessed portions in both of the first communication plate 151 and the second communication plate 152, respectively. Namely, the fifth flow path 205 is provided between from the nozzle 21 to the second common liquid chamber 102 while extending in the second direction Y which is the in-plane direction of the nozzle surface 20*a*. The fifth flow path 205 is equivalent to a downstream horizontal flow path described in the aspect.

The first individual flow path 200A described above has the first flow path 201, the pressure chamber 12, the second flow path 202, the first nozzle 21A, the third flow path 203, the fourth flow path 204, and the fifth flow path 205 in the order from an upstream region communicating with the first common liquid chamber 101 toward a downstream region communicating with the second common liquid chamber 102. Namely, in the embodiment, as illustrated in FIG. 4, in the first individual flow path 200A, the first pressure chamber 12A and the first nozzle 21A are disposed in the order from the upstream region toward the downstream region with respect to the flow of the ink from the first common liquid chamber 101 toward the second common liquid chamber 102.

In the first individual flow path 200A described above, the ink flows from the first common liquid chamber 101 to the second common liquid chamber 102 through the first individual flow path 200A. In addition, a change in the pressure of the ink in the first pressure chamber 12A is induced by driving the piezoelectric actuator 300, and ink droplets are discharged from the first nozzle 21A to the outside by increasing the pressure of the ink in the first nozzle 21A. When the ink flows from the first common liquid chamber 101 to the second common liquid chamber 102 through the first individual flow path 200A, the piezoelectric actuator 300 may be driven, and when the ink does not flow from the first common liquid chamber 101 to the second common liquid chamber 102 through the first individual flow path 200A, the piezoelectric actuator 300 may be driven. In addition, the ink may temporarily flow from the second common liquid chamber 102 to the first common liquid chamber 101 due to a pressure change induced by driving the piezoelectric actuator 300.

Incidentally, in the embodiment, in the first individual flow path 200A, flow paths upstream of the first nozzle 21A, namely, the second flow path 202, the first pressure chamber 12A, and the first flow path 201 which communicate with the first common liquid chamber 101 are referred to as first upstream flow paths. In addition, in the first individual flow path 200A, flow paths downstream of the first nozzle 21A, namely, the third flow path 203, the fourth flow path 204, and the fifth flow path 205 which communicate with the second common liquid chamber 102 are referred to as first downstream flow paths.

As illustrated in FIG. 3, the second individual flow path 200B includes a sixth flow path 206; a seventh flow path 207; an eighth flow path 208; the second nozzle 21B; a ninth flow path 209; the second pressure chamber 12B; and a tenth flow path 210.

The sixth flow path 206 is provided between the first communication plate 151 and the second communication plate 152 while extending along the second direction Y in the in-plane direction of the nozzle surface 20*a* so as for one end of the sixth flow path 206 to communicate with the first common liquid chamber 101. The sixth flow path 206 of the embodiment is formed by providing a recessed portion in the second communication plate 152 and covering the recessed portion with the first communication plate 151. Naturally, the sixth flow path 206 may be formed by providing a recessed portion in the first communication plate 151 and covering the recessed portion with the second communication plate 152, or may be formed by providing recessed portions in both of the first communication plate 151 and the second communication plate 152, respectively. Namely, the sixth flow path 206 is provided between from the nozzle 21 to the first common liquid chamber 101 while extending in the second direction Y which is the in-plane direction of the nozzle surface 20*a*. The sixth flow path 206 is equivalent to an upstream horizontal flow path described in the aspect.

The sixth flow path 206 described above and the first pressure chamber 12A of the first individual flow path 200A are disposed at different positions in the third direction Z which is the normal direction of the nozzle surface 20*a*. Specifically, the first pressure chamber 12A is provided close to the Z1 side with respect to the first communication plate 151, and the sixth flow path 206 is provided close to the Z2 side with respect to the first communication plate 151. The first pressure chamber 12A and the sixth flow path 206 are disposed at the different positions in the third direction Z. For this reason, even though the first pressure chamber 12A and the sixth flow path 206 are disposed proximate to each other in the first direction X, the thickness of a partition wall partitioning the first pressure chamber 12A is prevented from being reduced, and the partition wall of the first pressure chamber 12A is prevented from, by being deformed, absorbing the pressure of the ink in the first pressure chamber 12A, and thus it is possible to prevent the occurrence of variations in discharge characteristics. In addition, the first pressure chamber 12A and the sixth flow path 206 may be disposed such that at least parts of the first pressure chamber 12A and the sixth flow path 206 overlap each other in a plan view from the third direction Z. As described above, even though the first pressure chamber 12A and the sixth flow path 206 are disposed such that at least the parts of the first pressure chamber 12A and the sixth flow path 206 overlap each other in the plan view from the third direction Z, since the first pressure chamber 12A and the sixth flow path 206 are disposed at the different positions in the third direction Z, the first pressure chamber 12A and the sixth flow path 206 do not communicate with each other. Incidentally, in the embodiment, the sixth flow path 206 is disposed at a position where the sixth flow path 206 does not overlap the first pressure chamber 12A in the plan view from the third direction Z.

The seventh flow path 207 is provided such that one end of the seventh flow path 207 on the Z1 side communicates with the sixth flow path 206 and the seventh flow path 207 penetrates the second communication plate 152 in the third direction. Namely, the seventh flow path 207 is provided between from the nozzle 21 to the first common liquid chamber 101 while extending in the third direction Z which is the normal direction of the nozzle surface 20*a*. The seventh flow path 207 is equivalent to an upstream communication path described in the aspect.

Herein, the individual flow path 200 of the embodiment has, as illustrated in FIGS. 5 to 7, the second flow path 202 and the seventh flow path 207 that are the upstream communication paths provided between from the nozzle 21 to the first common liquid chamber 101 while extending in the third direction Z which is the normal direction of the nozzle surface 20*a* in which the nozzle 21 opens. The upstream communication paths of the individual flow paths 200 adjacent to each other in the first direction X which is the side by side arrangement direction of the nozzles 21, namely, the second flow path 202 of the first individual flow path 200A and the seventh flow path 207 of the second individual flow path 200B have the parts which do not overlap each other when seen from the first direction X which is the side by side arrangement direction of the nozzles 21. In the embodiment, the second flow path 202 and the seventh flow path 207 are disposed at positions which do not completely overlap each other in the second direction Y. Naturally, if the second flow path 202 and the seventh flow path 207 do not completely overlap each other in the plan view from the first direction X, parts of the second flow path 202 and the seventh flow path 207 may overlap each other. As described above, if the second flow path 202 and the seventh flow path 207 are disposed at the different positions in the second direction Y, the second flow paths 202 and the seventh flow paths 207 are disposed in a so-called staggered pattern along the first direction X.

In addition, in the embodiment, the seventh flow path 207 which is the upstream communication path of the second individual flow path 200B is disposed closer to the second common liquid chamber 102 in the second direction Y than the second flow path 202 which is the upstream communication path of the first individual flow path 200A. For this reason, the second flow path 202 which is the upstream communication path of the first individual flow path 200A is disposed intersecting the sixth flow path 206 which is the upstream horizontal flow path of the second individual flow path 200B in the plan view from the first direction X which is the side by side arrangement direction of the nozzles 21. Incidentally, the position of the seventh flow path 207 is not specifically limited to the position, and the seventh flow path 207 may be disposed closer to the first common liquid chamber 101 in the second direction Y than the second flow path 202. In this case, the second flow path 202 which is the communication path of the first individual flow path 200A does not intersect the sixth flow path 206 which is the upstream horizontal flow path of the second individual flow path 200B in the plan view from the first direction X which is the side by side arrangement direction of the nozzles 21. However, the flow path length of the eighth flow path 208 of the second individual flow path 200B becomes long, and thus there occurs a concern such as an increase in the flow path resistance. For this reason, such disposition is not preferable.

Furthermore, at least one of the second flow path 202 and the sixth flow path 206 of the embodiment is provided such that the width of an intersecting portion in the first direction X is narrower than the width of the other part. In the embodiment, a first narrow width portion 206*a* is provided in a portion of the sixth flow path 206 which intersects the second flow path 202, namely, a portion overlapping the second flow path 202 in the plan view from the first direction X, which has a width in the first direction X narrower than the width of the other part. Specifically, the sixth flow path 206 has, in the second direction Y, the first narrow width portion 206*a* that is provided close to the second common liquid chamber 102, and a first wide width portion 206*b* that is provided close to the first common liquid chamber 101 and has a width in the first direction X wider than the width of the first narrow width portion 206*a*. The first narrow width portion 206*a* is provided having a length to intersect the second flow path 202 in the plan view from the first direction X.

As described above, if the first wide width portion 206*b* is provided in the sixth flow path 206, compared to a case where only the first narrow width portion 206*a* is provided in the sixth flow path 206, since it is possible to reduce the flow path resistance and the inertance, a shortage of ink supply from the first common liquid chamber 101 to the second pressure chamber 12B is prevented from occurring, and thus it is possible to continuously discharge ink droplets in a short period. In addition, since it is possible to reduce the flow path resistance and the inertance of the sixth flow path 206, it is possible to prevent a reduction in the amount of ink circulation from the first common liquid chamber 101 to the second common liquid chamber 102.

As described above, if the second flow path 202 and the seventh flow path 207 are disposed so as to have the parts which do not overlap each other in the plan view from the first direction X, it is possible to improve the rigidity of a wall between the second flow paths 202 and the rigidity of a wall between the seventh flow paths 207 which are adjacent to each other in the first direction X, and thus the deformation of the walls of the second flow path 202 and the seventh flow path 207 is prevented which is caused by a pressure fluctuation when ink droplets are discharged, and the absorption of a pressure is prevented which takes place due to the deformation of the walls of the second flow path 202 and the seventh flow path 207. Therefore, it is possible to prevent the occurrence of cross talk caused by a reduction in the rigidities of the walls.

By the way, if the second flow path 202 and the seventh flow path 207 are disposed at positions which completely overlap each other in the plan view from the first direction X, a wall between the second flow path 202 and the seventh flow path 207 is formed to be thin in the third direction Z, and thus the wall is deformed due to a fluctuation in the pressure of the ink in the second flow path 202 and the seventh flow path 207, and cross talk occurs. In addition, if the second flow path 202 and the seventh flow path 207 are disposed at positions apart from each other in the first direction X so as to enhance the rigidity of the wall between the second flow path 202 and the seventh flow path 207, the nozzles 21 are disposed at a low density in the first direction X, and the size of the flow path substrate in the first direction X is increased. As in the embodiment, if the second flow path 202 and the seventh flow path 207 are disposed such that at least parts thereof do not overlap each other in the plan view from the first direction X, even though the second flow path 202 and the seventh flow path 207 are disposed relatively close to each other in the first direction X, it is possible to prevent a reduction in the rigidity of the wall, and it is possible to prevent the density of the nozzles 21 from becoming low, and to prevent a size increase of the flow path substrate.

The eighth flow path 208 is provided between the second communication plate 152 and the nozzle plate 20 while extending along the second direction Y in the in-plane direction of the nozzle surface 20*a* so as for one end of the eighth flow path 208 to communicate with the seventh flow path 207. The eighth flow path 208 of the embodiment is formed by providing a recessed portion in the second communication plate 152 and covering an opening of the recessed portion with the nozzle plate 20. Incidentally, the eighth flow path 208 is not specifically limited to the method, and may be formed by providing a recessed portion in the nozzle plate 20 and covering the recessed portion with the second communication plate 152, or may be formed by providing recessed portions in both of the second communication plate 152 and the nozzle plate 20, respectively. The eighth flow path 208 forms part of a flow path provided between the communication plate 15 that is the second flow path substrate and the nozzle plate 20 that is the third flow path substrate, which are described in the aspect. Namely, the third flow paths 203 and the eighth flow paths 208 are alternately disposed in the first direction X between the communication plate 15 which is the second flow path substrate and the nozzle plate 20 which is the third flow path substrate. A resolution when the third flow paths 203 and the eighth flow paths 208 are alternately disposed in the first direction X is referred to as a second resolution. The second resolution of the third flow path 203 and the eighth flow path 208 is larger than the first resolution of the first pressure chamber 12A or the second pressure chamber 12B. For example, if the first pressure chamber 12A is formed with the first resolution of 300 dpi and the second pressure chamber 12B is formed with the first resolution of 300 dpi, the third flow path 203 and the eighth flow path 208 are formed with the second resolution of 600 dpi. Therefore, if the first resolution of each of the first pressure chamber 12A and the second pressure chamber 12B is set smaller than the second resolution of the third flow path 203 and the eighth flow path 208, it is possible to widen the opening widths of the first pressure chamber 12A and the second pressure chamber 12B in the first direction X, and it is possible to increase the excluded volume of the pressure chamber 12.

The ninth flow path 209 is provided to penetrate the communication plate 15 in the third direction Z such that one end of the ninth flow path 209 on the Z2 side communicates with the second nozzle 21B and the other end on the Z1 side communicates with one end of the second pressure chamber 12B in the second direction Y. Namely, the ninth flow path 209 is provided between the second pressure chamber 12B and the second nozzle 21B while extending in the third direction Z which is the normal direction of the nozzle surface 20*a*. Namely, the ninth flow path 209 is provided between the nozzle 21 and the second common liquid chamber 102 while extending in the third direction Z which is the normal direction of the nozzle surface 20*a*. The ninth flow path 209 is equivalent to a downstream communication path described in the aspect.

Herein, the individual flow path 200 of the embodiment has the fourth flow path 204 and the ninth flow path 209 that are the downstream communication paths extending between from the nozzle 21 to the second common liquid chamber 102 in the third direction Z which is the normal direction of the nozzle surface 20*a* in which the nozzle 21 opens. The downstream communication paths of the individual flow paths adjacent to each other in the first direction X which is the side by side arrangement direction of the nozzles 21, namely, the fourth flow path 204 of the first individual flow path 200A and the ninth flow path 209 of the second individual flow path 200B have the parts which do not overlap each other when seen from the first direction X which is the side by side arrangement direction of the nozzles 21. In the embodiment, the fourth flow path 204 and the ninth flow path 209 are disposed at positions which do not completely overlap each other in the second direction Y.

Naturally, if the fourth flow path 204 and the ninth flow path 209 do not completely overlap each other in the plan view from the first direction X, parts of the fourth flow path 204 and the ninth flow path 209 may overlap each other. As described above, if the fourth flow path 204 and the ninth flow path 209 are disposed at the different positions in the second direction Y, the fourth flow paths 204 and the ninth flow paths 209 are disposed in a so-called staggered pattern along the first direction X.

In addition, in the embodiment, the fourth flow path 204 which is the downstream communication path of the first individual flow path 200A is disposed closer to the first common liquid chamber 101 in the second direction Y than the ninth flow path 209 which is the downstream communication path of the second individual flow path 200B. For this reason, the ninth flow path 209 which is the downstream communication path of the second individual flow path 200B is disposed intersecting the fifth flow path 205 which is the downstream horizontal flow path of the first individual flow path 200A in the plan view from the first direction X which is the side by side arrangement direction of the nozzles 21. Incidentally, the position of the fourth flow path 204 is not specifically limited to the position, and the fourth flow path 204 may be disposed closer to the second common liquid chamber 102 in the second direction Y than the ninth flow path 209. In this case, the ninth flow path 209 which is the communication path of the second individual flow path 200B does not intersect the fifth flow path 205 which is the downstream horizontal flow path of the first individual flow path 200A in the plan view from the first direction X which is the side by side arrangement direction of the nozzles 21. However, the flow path length of the third flow path 203 of the first individual flow path 200A becomes longer, and thus there occurs a concern such as an increase in the flow path resistance. For this reason, such disposition is not preferable.

Furthermore, at least one of the ninth flow path 209 and the fifth flow path 205 of the embodiment is provided such that the width of an intersecting portion in the first direction X is narrower than the width of the other part. In the embodiment, a portion of the fifth flow path 205 which intersects the ninth flow path 209, namely, a portion overlapping the ninth flow path 209 in the plan view from the first direction X is narrower than the other part. Specifically, the fifth flow path 205 has, in the second direction Y, a second narrow width portion 205*a* that is provided close to the first common liquid chamber 101 in the first direction X, and a second wide width portion 205*b* that is provided close to the second common liquid chamber 102 and has a width in the first direction X wider than the width of the second narrow width portion 205*a*. The second narrow width portion 205*a* is provided having a length to intersect the ninth flow path 209 in the plan view from the first direction X.

As described above, if the second wide width portion 205*b* is provided in the fifth flow path 205, compared to a case where only the second narrow width portion 205*a* is provided in the fifth flow path 205, since it is possible to reduce the flow path resistance and the inertance, an ink supply from the second common liquid chamber 102 to the first pressure chamber 12A is prevented from becoming short, and thus it is possible to continuously discharge ink droplets in a short period. In addition, it is possible to prevent a reduction in the amount of ink circulation from the first common liquid chamber 101 to the second common liquid chamber 102 by reducing the flow path resistance and the inertance of the fifth flow path 205.

As described above, if the fourth flow path 204 and the ninth flow path 209 are disposed so as to have the parts which do not overlap each other in the plan view from the first direction X, it is possible to improve the rigidity of a wall between the fourth flow paths 204 and the rigidity of a wall between the ninth flow paths 209 which are adjacent to each other in the first direction X, and thus the deformation of the walls of the fourth flow path 204 and the ninth flow path 209 is prevented which is caused by a pressure fluctuation when ink droplets are discharged, and the absorption of a pressure is prevented which takes place due to the deformation of the walls of the fourth flow path 204 and the ninth flow path 209. Therefore, it is possible to prevent the occurrence of cross talk caused by a reduction in the rigidities of the walls.

By the way, if the fourth flow path 204 and the ninth flow path 209 are disposed at positions which completely overlap each other in the plan view from the first direction X, a wall between the fourth flow path 204 and the ninth flow path 209 is formed to be thin in the third direction Z, and thus the wall is deformed due to a fluctuation in the pressure of the ink in the fourth flow path 204 and the ninth flow path 209, and cross talk occurs. In addition, if the fourth flow path 204 and the ninth flow path 209 are disposed at positions apart from each other in the first direction X so as to enhance the rigidity of the wall between the fourth flow path 204 and the ninth flow path 209, the nozzles 21 are disposed at a low density in the first direction X, and the size of the flow path substrate in the first direction X is increased. As in the embodiment, if the fourth flow path 204 and the ninth flow path 209 are disposed such that at least parts thereof do not overlap each other in the plan view from the first direction X, even though the fourth flow path 204 and the ninth flow path 209 are disposed relatively close to each other in the first direction X, it is possible to prevent a reduction in the rigidity of the wall, and it is possible to prevent the density of the nozzles 21 from becoming low, and to prevent a size increase of the flow path substrate.

The second pressure chamber 12B is provided, as described above, in the flow path formation substrate 10. A Z1 side opening of the second pressure chamber 12B is sealed with the vibrating plate 50, and part of a Z2 side opening of the second pressure chamber 12B is covered with the communication plate 15. The second pressure chamber 12B described above is disposed at a position different from the position of the first pressure chamber 12A of the first individual flow path 200A in the second direction Y. The first pressure chamber 12A and the second pressure chamber 12B are provided at positions which do not overlap each other in the plan view from the first direction X. Similar to the first pressure chamber 12A, the second pressure chamber 12B described above is formed with the first resolution in the first direction X.

In addition, the second pressure chamber 12B and the fifth flow path 205 of the first individual flow path 200A are disposed at different positions in the third direction Z which is the normal direction of the nozzle surface 20*a*. Specifically, the second pressure chamber 12B is provided close to the Z1 side with respect to the first communication plate 151, the fifth flow path 205 is provided close to the Z2 side with respect to the first communication plate 151. The second pressure chamber 12B and the fifth flow path 205 are disposed at the different positions in the third direction Z. For this reason, even though the second pressure chamber 12B and the fifth flow path 205 are disposed proximate to each other in the first direction X, the thickness of a partition wall partitioning the second pressure chamber 12B is prevented from being reduced, and thus it is possible to prevent the occurrence of variations in discharge characteristics, which is caused by the absorption of a pressure due to the partition wall of the second pressure chamber 12B being deformed. In addition, the second pressure chamber 12B and the fifth flow path 205 may be disposed such that at least parts of the second pressure chamber 12B and the fifth flow path 205 overlap each other in the plan view from the third direction Z. As described above, even though the second pressure chamber 12B and the fifth flow path 205 are disposed such that at least the parts of the second pressure chamber 12B and the fifth flow path 205 overlap each other in the plan view from the third direction Z, since the second pressure chamber 12B and the fifth flow path 205 are disposed at the different positions in the third direction Z, the second pressure chamber 12B and the fifth flow path 205 do not communicate with each other. Incidentally, in the embodiment, the fifth flow path 205 is disposed at a position where the fifth flow path 205 does not overlap the second pressure chamber 12B in the plan view from the third direction Z.

The second nozzle 21B is provided to communicate with one end of the ninth flow path 209 on the Z2 side, and open in the nozzle surface 20*a* of the nozzle plate 20 on the Z2 side to communicate with the outside.

The tenth flow path 210 is a flow path through which the second pressure chamber 12B communicates with the second common liquid chamber 102. The tenth flow path 210 is provided to penetrate the first communication plate 151 in the third direction Z such that one end of the tenth flow path 210 on the Z1 side communicates with the other end of the second pressure chamber 12B in the second direction Y and the other end on the Z2 side communicates with the second communication portion 17 forming the second common liquid chamber 102.

The second individual flow path 200B described above has the sixth flow path 206, the seventh flow path 207, the eighth flow path 208, the second nozzle 21B, the ninth flow path 209, the second pressure chamber 12B, and the tenth flow path 210 in the order from the upstream region communicating with the first common liquid chamber 101 toward the downstream region communicating with the second common liquid chamber 102. Namely, in the embodiment, as illustrated in FIG. 4, in the second individual flow path 200B, the second nozzle 21B and the second pressure chamber 12B are disposed in the order from the upstream region toward the downstream region with respect to the flow of the ink from the first common liquid chamber 101 toward the second common liquid chamber 102. Namely, the pressure chamber 12 and the nozzle 21 are disposed in different orders between the first individual flow path 200A and the second individual flow path 200B with respect to the flow of the ink from the first common liquid chamber 101 toward the second common liquid chamber 102. In the embodiment, since each of the individual flow paths 200 is provided with one pressure chamber 12 and one nozzle 21, the pressure chamber 12 and the nozzle 21 are disposed in a reverse order between the first individual flow path 200A and the second individual flow path 200B.

In the second individual flow path 200B described above, the ink flows from the first common liquid chamber 101 to the second common liquid chamber 102 through the second individual flow path 200B. In addition, a change in the pressure of the ink in the second pressure chamber 12B is induced by driving the piezoelectric actuator 300, and ink droplets are discharged from the second nozzle 21B to the outside by increasing the internal pressure of the second nozzle 21B. When the ink flows from the first common liquid chamber 101 to the second common liquid chamber 102 through the second individual flow path 200B, the piezoelectric actuator 300 may be driven, and when the ink does not flow from the first common liquid chamber 101 to the second common liquid chamber 102 through the second individual flow path 200B, the piezoelectric actuator 300 may be driven. In addition, the ink may temporarily flow from the second common liquid chamber 102 to the first common liquid chamber 101 due to a pressure change induced by driving the piezoelectric actuator 300. By the way, the discharge of ink droplets from the second nozzle 21B is determined by the pressure of the ink in the second nozzle 21B. The pressure of the ink in the second nozzle 21B is determined by the pressure of the ink flowing from the first common liquid chamber 101 toward the second common liquid chamber 102, namely, a so-called circulation pressure and the pressure of the ink that flows from the second pressure chamber 12B toward the second nozzle 21B due to the piezoelectric actuator 300 being driven.

For example, with respect to the flow of the ink from the first common liquid chamber 101 toward the second common liquid chamber 102, due to a fluctuation in the pressure of the ink in the second pressure chamber 12B, the ink may flow backward from the second pressure chamber 12B toward the second nozzle 21B, and ink droplets may be discharged from the second nozzle 21B. As described above, the fact that the ink flows backward from the second pressure chamber 12B toward the second nozzle 21B implies that the pressure of circulation from the first common liquid chamber 101 toward the second common liquid chamber 102 is low, and thus it is possible to reduce a pressure loss of the individual flow path 200 by reducing the pressure of circulation to a relatively low pressure. If the pressure loss of each of the individual flow paths 200 is reduced, since it is possible to reduce a difference in pressure loss between the individual flow paths 200, it is possible to reduce variations in the discharge characteristics of ink droplets to be discharged from each of the nozzles 21.

In addition, for example, with respect to the flow of the ink from the first common liquid chamber 101 toward the second common liquid chamber 102, due to a fluctuation in the pressure of the ink in the second pressure chamber 12B, the ink may be discharged from the second nozzle 21B without the backflow of the ink from the second pressure chamber 12B toward the second nozzle 21B. In this case, since the flow of the ink from the second pressure chamber 12B toward the second nozzle 21B is not formed, it is difficult for air bubbles to flow backward from the second pressure chamber 12B toward the second nozzle 21B, and it is difficult for air bubbles to cause poor discharge of ink droplets from the second nozzle 21B.

Incidentally, in the embodiment, in the second individual flow path 200B, flow paths upstream of the second nozzle 21B, namely, the sixth flow path 206, the seventh flow path 207, and the eighth flow path 208 which communicate with the first common liquid chamber 101 are referred to as second upstream flow paths. In addition, in the second individual flow path 200B, flow paths downstream of the second nozzle 21B, namely, the ninth flow path 209, the second pressure chamber 12B, and the tenth flow path 210 which communicate with the second common liquid chamber 102 are referred to as second downstream flow paths.

The first individual flow paths 200A and the second individual flow paths 200B described above are, as illustrated in FIG. 4, alternately provided in the first direction X. Namely, with respect to the flow of the ink from the first common liquid chamber 101 toward the second common liquid chamber 102, regardless of the positions of the pressure chamber 12 and the nozzle 21, it is possible to discharge ink droplets from the nozzle 21 due to a fluctuation in the internal pressure of the pressure chamber 12. Namely, even though as in the first individual flow path 200A, the first pressure chamber 12A is disposed upstream and the first nozzle 21A is disposed downstream, and even though as in the second individual flow path 200B, the second nozzle 21B is disposed upstream and the second pressure chamber 12B is disposed downstream, it is possible to selectively discharge ink droplets from both of the first nozzle 21A and the second nozzle 21B due to a fluctuation in the pressure of the ink in the pressure chamber 12. For this reason, as described above, if with respect to the flow of the ink from the first common liquid chamber 101 toward the second common liquid chamber 102, the first individual flow paths 200A and the second individual flow paths 200B between which the order of the pressure chamber 12 and the nozzle 21 differs are alternately disposed in the first direction X, it is possible to change the position of the pressure chamber 12 between the first individual flow path 200A and the second individual flow path 200B, namely, to dispose the first pressure chamber 12A and the second pressure chamber 12B at different positions in the second direction Y. Therefore, it is possible to form the pressure chamber 12 having a wide width in the first direction X in each of the individual flow paths 200, and it is possible to dispose the pressure chambers 12 at a high density in the first direction X. Namely, if the first pressure chamber 12A and the second pressure chamber 12B are disposed at the different positions in the second direction Y, it is possible to thicken a partition wall between the first pressure chambers 12A that are arranged side by side in the first direction X, and it is possible to thicken a partition wall between the second pressure chambers 12B that are arranged side by side in the first direction X. Therefore, even though each of the first pressure chamber 12A and the second pressure chamber 12B is formed having a wide width in the first direction X, it is possible to prevent a reduction in the rigidity of the partition wall, it is possible to improve the discharge characteristics of ink droplets, namely, to increase the weight of ink droplets by increasing the excluded volume, and it is possible to prevent the occurrence of cross talk caused by a reduction in the rigidity of the partition wall. In addition, even though the first pressure chambers 12A and the second pressure chamber 12Bs are disposed at a high density in the first direction X, it is possible to prevent a reduction in the rigidity of the partition wall, and it is possible to prevent the occurrence of cross talk caused by a reduction in the rigidity of the partition wall.

By the way, for example, if the second individual flow path 200B is not provided and only the first individual flow paths 200A are arranged side by side in the first direction X, when the first pressure chambers 12A are disposed at a high density in the first direction X, the thickness of the partition wall between the first pressure chambers 12A adjacent to each other is reduced, and the rigidity of the partition wall is reduced. As described above, if the rigidity of the partition wall is reduced, cross talk occurs due to the deformation of the partition wall. Namely, if ink droplets are simultaneously discharged from the nozzles 21 on both sides of the nozzle 21 discharging ink droplets, pressures are applied, at the same timing, from both sides to the partition wall between the first pressure chambers 12A adjacent to each other. In this case, since pressures are applied from both sides to the partition wall, regardless of the rigidity of the partition wall, it is difficult for the partition wall to be deformed. On the other hand, if ink droplets are not discharged from the nozzles 21 on both sides of the nozzle 21 discharging ink droplets, a pressure is applied from only one side to the partition wall between the first pressure chambers 12A adjacent to each other. At that time, if the rigidity of the partition wall is low, the partition wall is deformed to absorb a pressure fluctuation, and the discharge characteristics of the ink droplets deteriorate. For this reason, variations in the discharge characteristics of ink droplets occur depending on a difference in condition such as which nozzle discharging ink droplets among the plurality of nozzles 21. Therefore, if only the first pressure chamber 12A is provided, it is not possible to form the first pressure chamber 12A having a wide width in the first direction X, and it is not possible to dispose the first pressure chambers 12A at a high density in the first direction X.

In the embodiment, since the first pressure chamber 12A and the second pressure chamber 12B are disposed at the different positions in the second direction Y, it is possible to increase the thickness of the partition wall between the first pressure chambers 12A, which are adjacent to each other in the first direction X, to a relatively large thickness, and it is possible to increase the thickness of the partition wall between the second pressure chambers 12B, which are adjacent to each other in the first direction X, to a relatively large thickness. For this reason, even though each of the first pressure chamber 12A and the second pressure chamber 12B is formed having a wide width in the first direction X, it is possible to prevent a reduction in the rigidity of the partition wall between the first pressure chambers 12A and in the rigidity of the partition wall between the second pressure chambers 12B. Therefore, it is possible to increase the volumes of the first pressure chamber 12A and the second pressure chamber 12B by preventing a size increase of the flow path substrate in the first direction X, it is possible to improve the discharge characteristics of ink droplets, particularly, to increase the weight of ink droplets by increasing the excluded volume by the driving of the piezoelectric actuator 300, and it is possible to prevent the occurrence of cross talk caused by a reduction in the rigidity of the partition wall.

In addition, even though a gap between the first pressure chamber 12A and the second pressure chamber 12B in the first direction X is shortened, since it is possible to prevent a reduction in the rigidity of the partition wall between the first pressure chambers 12A and in the rigidity of the partition wall between the second pressure chambers 12B, it is possible to dispose the first pressure chambers 12A and the second pressure chambers 12B at a high density in the first direction X. Therefore, it is possible to improve the discharge characteristics of ink droplets by attaining a size reduction of the flow path substrate in the first direction X and increasing the excluded volume of the pressure chamber 12, it is possible to dispose the nozzles 21 at a high density by disposing the pressure chambers 12 at a high density in the first direction X, and it is possible to prevent the occurrence of cross talk caused by a reduction in the rigidity of the partition wall.

In addition, in the embodiment, the first nozzle 21A is disposed at a position where the first nozzle 21A communicates with the other end of the second flow path 202 that has one end communicating with the first pressure chamber 12A and is a first communication path along the third direction Z. For this reason, it is possible to increase the weight of ink droplets discharged from the first nozzle 21A by increasing the cross-sectional area of the second flow path 202 from the first pressure chamber 12A to the first nozzle 21A, and reducing the flow path resistance of the second flow path 202.

Similarly, in the embodiment, the second nozzle 21B is disposed at a position where the second nozzle 21B communicates with the other end of the eighth flow path 208 that has one end communicating with the second pressure chamber 12B and is a second communication path along the third direction Z. For this reason, it is possible to increase the weight of ink droplets discharged from the second nozzle 21B by increasing the cross-sectional area of the eighth flow path 208 from the second pressure chamber 12B to the second nozzle 21B, and reducing the flow path resistance of the eighth flow path 208.

Namely, in the embodiment, if the first nozzle 21A and the second nozzle 21B are disposed at different positions in the second direction Y so as for the first nozzle 21A and the second nozzle 21B to directly communicate with the second flow path 202 and the eighth flow path 208, respectively, and the nozzles 21 are disposed in a so-called staggered pattern in the first direction X, it is possible to increase the weight of ink droplets discharged from the first nozzle 21A and the second nozzle 21B.

Naturally, the first nozzle 21A may be disposed in the middle of the third flow path 203 so as to communicate therewith, and the second nozzle 21B may be disposed in the middle of the seventh flow path 207 so as to communicate therewith. However, since each of the third flow path 203 and the seventh flow path 207 is restricted in having a large flow path cross-sectional area, particularly, a large height in the third direction Z by the thickness of the communication plate 15 in the third direction Z, the third flow path 203 and the seventh flow path 207 are likely to have a large flow path resistance compared to the second flow path 202 and the eighth flow path 208. Therefore, there occurs a concern such as the weight of ink droplets discharged from the first nozzle 21A and the second nozzle 21B being relatively small.

In addition, in the embodiment, the individual flow path 200 is provided such that the flow path resistance of the upstream flow path closer to the first common liquid chamber 101 than the nozzle 21 is equal to the flow path resistance of the downstream flow path closer to the second common liquid chamber 102 than the nozzle 21.

Namely, the flow path resistance of the first upstream flow path is equal to the flow path resistance of the first downstream flow path in the first individual flow path 200A. Namely, the first upstream flow path and the first downstream flow path are formed such that the sum of the flow path resistances of the first flow path 201, the first pressure chamber 12A, and the second flow path 202 forming the first upstream flow path is equal to the sum of the flow path resistances of the third flow path 203, the fourth flow path 204, and the fifth flow path 205 forming the first downstream flow path. Herein, the flow path resistance of the first upstream flow path and the first downstream flow path is determined by a flow path cross-sectional area, the flow path length, and the shape of the flow path.

In addition, the second upstream flow path and the second downstream flow path of the second individual flow path 200B have the same flow path resistance. Namely, the second upstream flow path and the second downstream flow path are formed such that the sum of the flow path resistances of the sixth flow path 206, the seventh flow path 207, and the eighth flow path 208 forming the second upstream flow path is equal to the sum of the flow path resistances of the ninth flow path 209, the second pressure chamber 12B, and the tenth flow path 210 forming the second downstream flow path.

In the embodiment, the first individual flow path 200A and the second individual flow path 200B have shapes inverted with respect to an ink flow direction from the first common liquid chamber 101 toward the second common liquid chamber 102. Namely, the first upstream flow path of the first individual flow path 200A and the second downstream flow path of the second individual flow path 200B are provided so as to have the same shape and the same flow path resistance. The first downstream flow path of the first individual flow path 200A and the second upstream flow path of the second individual flow path 200B are provided so as to have the same shape and the same flow path resistance.

As described above, if the first upstream flow path and the first downstream flow path of the first individual flow path 200A have the same flow path resistance, and the second upstream flow path and the second downstream flow path of the second individual flow path 200B have the same flow path resistance, even though the first individual flow path 200A and the second individual flow path 200B have shapes inverted with respect to the ink flow direction from the first common liquid chamber 101 toward the second common liquid chamber 102, it is possible to equalize the flow path resistances of the first upstream flow path equal and the second upstream flow path from the first common liquid chamber to the nozzle 21. Therefore, it is possible to prevent the occurrence of variations in the discharge characteristics of ink droplets to be discharged from the first nozzle 21A of the first individual flow path 200A and in the discharge characteristics of ink droplets to be discharged from the second nozzle 21B of the second individual flow path 200B, and it is possible to simplify the structures of the flow paths.

In addition, if the flow path resistance of the first downstream flow path of the first individual flow path 200A is made equal to that of the second downstream flow path of the second individual flow path 200B, it is possible to equalize the discharge characteristics of ink droplets to be discharged from the nozzles 21. Namely, if ink droplets are simultaneously discharged from the plurality of nozzles 21, since the ink is supplied to the pressure chambers 12 from both of the first common liquid chamber 101 and the second common liquid chamber 102, it is possible to prevent the occurrence of variations in the amount of ink supply, and to prevent the occurrence of variations in the discharge characteristics of ink droplets by making the flow path resistance of the first downstream flow path equal to that of the second downstream flow path.

By the way, for example, if the flow path resistance of the first upstream flow path is different from that of the first downstream flow path in the first individual flow path 200A, when the second individual flow path 200B is formed by inverting the first individual flow path 200A, since the first downstream flow path of the first individual flow path 200A becomes the second upstream flow path of the second individual flow path 200B, the flow path resistances of the first upstream flow path and the second upstream flow path from the first common liquid chamber 101 to the nozzle 21 become different from each other. For this reason, there occur variations in the discharge characteristics of ink droplets to be discharged from the first nozzle 21A of the first individual flow path 200A and the second nozzle 21B of the second individual flow path 200B. In addition, in order to form the first upstream flow path and the second upstream flow path having the same flow path resistance, the second upstream flow path must be formed having a cross-sectional area, a flow path length, a shape, and the like different from those of the first downstream flow path, which causes complexity.

In addition, in a state where the ink has flown from the first common liquid chamber 101 to the second common liquid chamber 102 via the individual flow paths 200, in a non-discharge period where ink droplets are not discharged from the nozzles 21, preferably, a difference of the internal ink pressure, relative to atmospheric pressure, of each of the nozzles 21 of the individual flow paths 200 adjacent to each other in the first direction X which is the side by side arrangement direction of the nozzles 21 is from −2% to +2%. For example, if the atmospheric pressure is 1,013 hPa, the internal pressure of the nozzle 21 is approximately 1,000 hPa. Therefore, a difference of internal ink pressure between the nozzles 21 adjacent to each other is approximately a maximum of 20 hPa.

As described above, if in a non-discharge period, the difference of internal ink pressure between the first nozzle 21A and the second nozzle 21B which are adjacent to each other in the first direction X is relatively small such as from −2% to +2%, it is possible to prevent the occurrence of variations in the discharge characteristics of ink droplets to be discharged from the first nozzle 21A and in the discharge characteristics of ink droplets to be discharged from the second nozzle 21B. As described above, in order to attain a relatively small difference of internal ink pressure between the first nozzle 21A and the second nozzle 21B, it is necessary to make the flow path resistance from the first common liquid chamber 101 to the first nozzle 21A equal to the flow path resistance from the first common liquid chamber 101 to the second nozzle 21B such that the difference of internal ink pressure between the nozzles 21 is from −2% to +2%. If the flow path resistance from the first common liquid chamber 101 to the first nozzle 21A and the flow path resistance from the first common liquid chamber 101 to the second nozzle 21B are formed such that the difference of internal ink pressure between the nozzles 21 is from −2% to +2%, since the first individual flow path 200A and the second individual flow path 200B have the same shape and the shapes inverted with respect to the ink flow direction, it is possible to simplify the structure of the individual flow path 200, and to dispose the first pressure chamber 12A and the second pressure chamber 12B at different positions in the second direction Y.

In addition, the flow path resistance of the first upstream flow path and the first downstream flow path, the flow path resistance of the second upstream flow path and the second downstream flow path, or the difference of internal ink pressure between two nozzles 21 adjacent to each other in the first direction X is not limited to that described above. For example, the flow path resistance of the first upstream flow path and the first downstream flow path may be different from the flow path resistance of the second upstream flow path and the second downstream flow path, or the pressure of the ink in the first nozzle 21A and the pressure of the ink in the second nozzle 21B may be less than −2% or greater than +2%. In the case described above, different voltages may be applied to the piezoelectric actuators 300 of the individual flow paths 200 adjacent to each other in the side by side arrangement direction of the nozzles 21.

For example, if the first individual flow path 200A and the second individual flow path 200B have inverted structures, when the flow path resistance of the first upstream flow path is larger than that of the first downstream flow path, the pressure of the ink in the first nozzle 21A becomes low, and the weight of ink droplets to be discharged from the first nozzle 21A becomes small. On the other hand, if the first individual flow path 200A and the second individual flow path 200B have inverted structures, the flow path resistance of the second upstream flow path is smaller than the flow path resistance of the second downstream flow path, and the pressure of the ink in the second nozzle 21B becomes low. Therefore, the weight of ink droplets to be discharged from the second nozzle 21B becomes large. Therefore, a voltage to be applied to the piezoelectric actuator 300 corresponding to the first individual flow path 200A is made relatively higher than a voltage to be applied to the piezoelectric actuator 300 corresponding to the second individual flow path 200B. Incidentally, in order to make a voltage to be applied to the piezoelectric actuator 300 corresponding to the first individual flow path 200A relatively higher than a voltage to be applied to the piezoelectric actuator 300 corresponding to the second individual flow path 200B, for example, the voltage to be applied to the piezoelectric actuator 300 corresponding to the first individual flow path 200A may be made high, the voltage to be applied to the piezoelectric actuator 300 corresponding to the second individual flow path 200B may be made low, or both voltages may be adjusted with respect to a reference voltage. In this way, even though there occurs a relatively large difference of internal ink pressure between the first nozzle 21A and the second nozzle 21B, it is possible to reduce variations in the weight of ink droplets to be discharged from the first nozzle 21A and the second nozzle 21B, and to improve print quality by adjusting a voltage to be applied to the piezoelectric actuator 300.

As described above, the ink jet type recording head 1 which is one example of the liquid ejecting head of the embodiment includes a flow path substrate in which a flow path is formed, and the piezoelectric actuator 300 which is an energy generating element for inducing a change in the pressure of an ink which is a liquid of the flow path. The flow path contains the first common liquid chamber 101; the second common liquid chamber 102; and the plurality of individual flow paths 200 which communicate with the first common liquid chamber 101 and the second common liquid chamber 102 and through which the liquid flows from the first common liquid chamber 101 toward the second common liquid chamber 102. The individual flow path 200 includes the nozzle 21 that communicates with the outside; the pressure chamber 12 in which a pressure change is induced by the piezoelectric actuator 300; and the second flow path 202 and the seventh flow path 207 that are upstream communication paths extending between from the nozzle 21 to the first common liquid chamber 101 in the third direction Z which is the normal direction of the nozzle surface 20*a* in which the nozzle 21 opens. The second flow path 202 and the seventh flow path 207 of the first individual flow path 200A and the second individual flow path 200B, which are the individual flow paths 200 adjacent to each other in the first direction X which is a side by side arrangement direction of the nozzles 21, have the parts which do not overlap each other in the plan view from the first direction X.

As described above, if the second flow path 202 and the seventh flow path 207 are disposed so as to have the parts which do not overlap each other in the plan view from the first direction X, it is possible to improve the rigidity of the wall between the second flow paths 202 and the rigidity of the wall between the seventh flow paths 207 which are adjacent to each other in the first direction X, and thus the deformation of the walls of the second flow path 202 and the seventh flow path 207 is prevented which is caused by a pressure fluctuation when ink droplets are discharged, and the absorption of a pressure is prevented which takes place due to the deformation of the walls of the second flow path 202 and the seventh flow path 207. Therefore, it is possible to prevent the occurrence of cross talk caused by a reduction in the rigidities of the walls.

By the way, if the second flow path 202 and the seventh flow path 207 are disposed at positions which completely overlap each other in the plan view from the first direction X, the wall between the second flow path 202 and the seventh flow path 207 is formed to be thin in the third direction Z, and thus the wall is deformed due to a fluctuation in the pressure of the ink in the second flow path 202 and the seventh flow path 207, and cross talk occurs. In addition, if the second flow path 202 and the seventh flow path 207 are disposed at positions apart from each other in the first direction X so as to enhance the rigidity of the wall between the second flow path 202 and the seventh flow path 207, the nozzles 21 are disposed at a low density in the first direction X, and the size of the flow path substrate in the first direction X is increased. As in the embodiment, if the second flow path 202 and the seventh flow path 207 are disposed such that at least parts thereof do not overlap each other in the plan view from the first direction X, even though the second flow path 202 and the seventh flow path 207 are disposed relatively close to each other in the first direction X, it is possible to prevent a reduction in the rigidity of the wall, and it is possible to prevent the density of the nozzles 21 from becoming low, and to prevent a size increase of the flow path substrate.

In addition, in the recording head 1 of the embodiment, the second individual flow path 200B, which is one of two individual flow paths 200 adjacent to each other in the first direction X which is the side by side arrangement direction, has the sixth flow path 206 that is the upstream horizontal flow path provided extending in the second direction Y which is the in-plane direction of the nozzle surface 20*a*, and intersecting, in the plan view from the first direction X, the second flow path 202 which is the upstream communication path of the first individual flow path 200A which is the other individual flow path. In at least one of the second flow path 202 and the sixth flow path 206, a portion in which the second flow path 202 and the sixth flow path 206 intersect each other has a width in the first direction X narrower than the width of the other part.

In the embodiment, since the sixth flow path 206 is provided with the first narrow width portion 206*a* and the first wide width portion 206*b*, it is possible to prevent poor ink supply from the first common liquid chamber 101 to the second pressure chamber 12B, and to discharge ink droplets in a short period. In addition, it is possible to prevent a reduction in the amount of ink circulation from the first common liquid chamber 101 to the second common liquid chamber 102 by reducing the flow path resistance and the inertance of the sixth flow path 206.

Naturally, the sixth flow path 206 may be provided such that the width thereof in the first direction X remains the same in the second direction Y.

In addition, in the recording head 1 of the embodiment, the individual flow path 200 further has the fourth flow path 204 and the ninth flow path 209 that are the downstream communication paths extending between from the nozzle 21 to the second common liquid chamber 102 in the third direction Z which is the normal direction of the nozzle surface 20*a*. The fourth flow path 204 and the ninth flow path 209 of the first individual flow path 200A and the second individual flow path 200B, which are the individual flow paths adjacent to each other in the first direction X which is the side by side arrangement direction, have the parts which do not overlap each other in the plan view from the first direction X.

As described above, if the fourth flow path 204 and the ninth flow path 209 are disposed so as to have the parts which do not overlap each other in the plan view from the first direction X, it is possible to improve the rigidity of the wall between the fourth flow paths 204 and the rigidity of the wall between the ninth flow paths 209 which are adjacent to each other in the first direction X, and the deformation of the walls of the fourth flow path 204 and the ninth flow path 209 is prevented which is caused by a pressure fluctuation when ink droplets are discharged, and the absorption of a pressure is prevented which takes place due to the deformation of the walls of the fourth flow path 204 and the ninth flow path 209. Therefore, it is possible to prevent the occurrence of cross talk caused by a reduction in the rigidities of the walls.

By the way, if the fourth flow path 204 and the ninth flow path 209 are disposed at positions which completely overlap each other in the plan view from the first direction X, the wall between the fourth flow path 204 and the ninth flow path 209 is formed to be thin in the third direction Z, and thus the wall is deformed due to a fluctuation in the pressure of the ink in the fourth flow path 204 and the ninth flow path 209, and cross talk occurs. In addition, if the fourth flow path 204 and the ninth flow path 209 are disposed at positions apart from each other in the first direction X so as to enhance the rigidity of the wall between the fourth flow path 204 and the ninth flow path 209, the nozzles 21 are disposed at a low density in the first direction X, and the size of the flow path substrate in the first direction X is increased. As in the embodiment, if the fourth flow path 204 and the ninth flow path 209 are disposed such that at least parts thereof do not overlap each other in the plan view from the first direction X, even though the fourth flow path 204 and the ninth flow path 209 are disposed relatively close to each other in the first direction X, it is possible to prevent a reduction in the rigidity of the wall, and it is possible to prevent the density of the nozzles 21 from becoming low, and to prevent a size increase of the flow path substrate.

In addition, in the recording head 1 of the embodiment, the second individual flow path 200B, which is one of two individual flow paths 200 adjacent to each other in the first direction X which is the side by side arrangement direction, has the ninth flow path 209 that is the downstream horizontal flow path provided extending in the second direction Y which is the in-plane direction of the nozzle surface 20*a*, and intersecting, in the plan view from the first direction X, the fifth flow path 205 which is the downstream communication path of the first individual flow path 200A which is the other individual flow path. In at least one of the fifth flow path 205 and the ninth flow path 209, a portion in which the fifth flow path 205 and the ninth flow path 209 intersect each other has a width in the first direction X narrower than the width of the other part.

In the embodiment, since the fifth flow path 205 is provided with the second narrow width portion 205*a* and the second wide width portion 205*b*, it is possible to reduce the flow path resistance and the inertance of the fifth flow path 205, and thus it is possible to prevent poor ink supply from the second common liquid chamber 102 to the first pressure chamber 12A, and to continuously discharge ink droplets in a short period. In addition, it is possible to prevent a reduction in the amount of ink circulation from the first common liquid chamber 101 to the second common liquid chamber 102 by reducing the flow path resistance and the inertance of the fifth flow path 205.

Naturally, the fifth flow path 205 may be provided such that the width thereof in the first direction X remains the same in the second direction Y.

Incidentally, the embodiment employs a configuration where the nozzle plate 20 and the compliance substrate 49 are provided as separate bodies, but the present disclosure is not limited to the configuration. For example, the nozzle plate 20 may be provided having a size to cover the openings of the first common liquid chamber 101 and the second common liquid chamber 102, and the compliance portion 494 may be provided in part of the nozzle plate 20. The nozzle plate 20 provided with the compliance portion 494 as described above can be manufactured of a resin film such as a polyimide film, or a metallic material such as stainless steel.

As described above, if the compliance portion 494 is provided in part of the nozzle plate 20, since the nozzle plate 20 covers the openings of the first common liquid chamber 101 and the second common liquid chamber 102, the nozzle plate 20 covers spaces between the first common liquid chamber 101 and the nozzle 21 and between the second common liquid chamber 102 and the nozzle 21 which are on a Z2 side of the communication plate 15. For this reason, it is possible to form the ninth flow path 209, the tenth flow path 210, or the like, which is part of the individual flow path 200 communicating with the first common liquid chamber 101 and the second common liquid chamber 102, in a joint interface between the nozzle plate 20 and the communication plate 15. Since the ninth flow path 209, the tenth flow path 210, or the like which is part of the individual flow path 200 is formed in the joint interface between the nozzle plate 20 and the communication plate 15, it is not necessary to manufacture the communication plate 15 by laminating a plurality of substrates on top of each other, and it is possible to manufacture the communication plate 15 from one piece of substrate.

Embodiment 2

Figure 8:
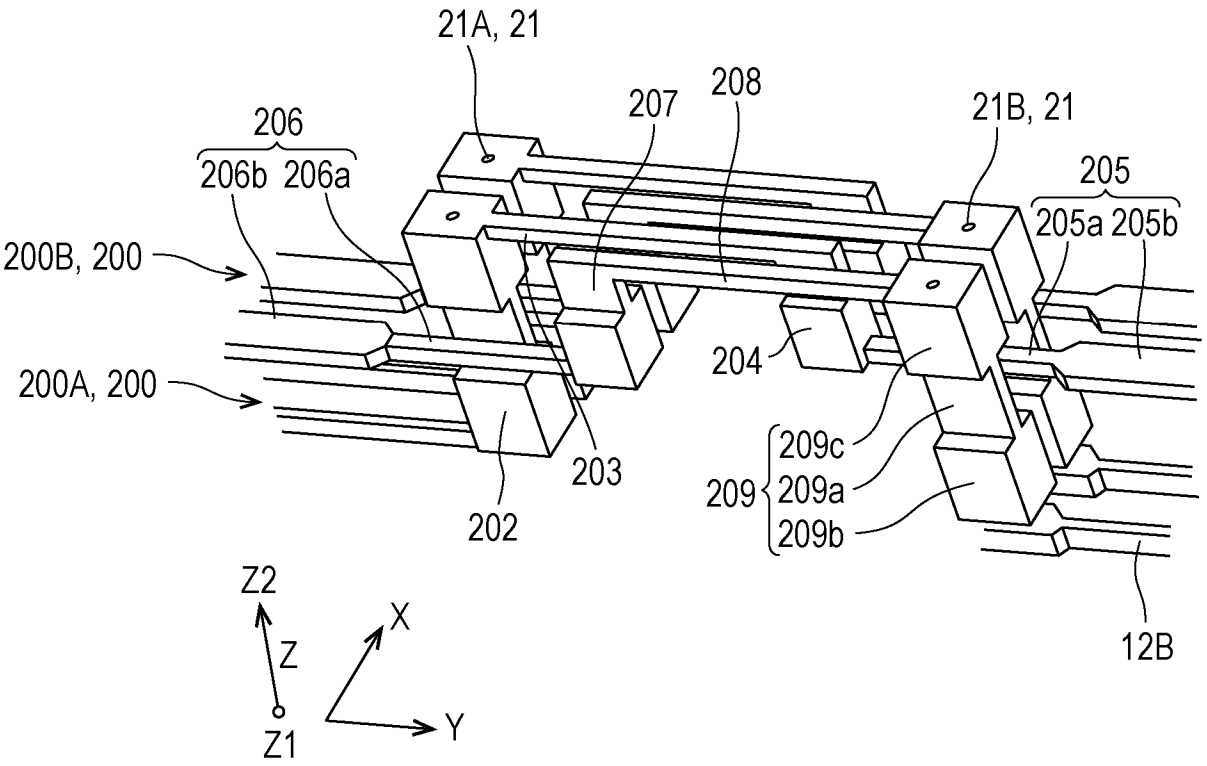
FIG. 8 is a perspective view of flow paths according to Embodiment 2 of the present disclosure.
Figure 9:
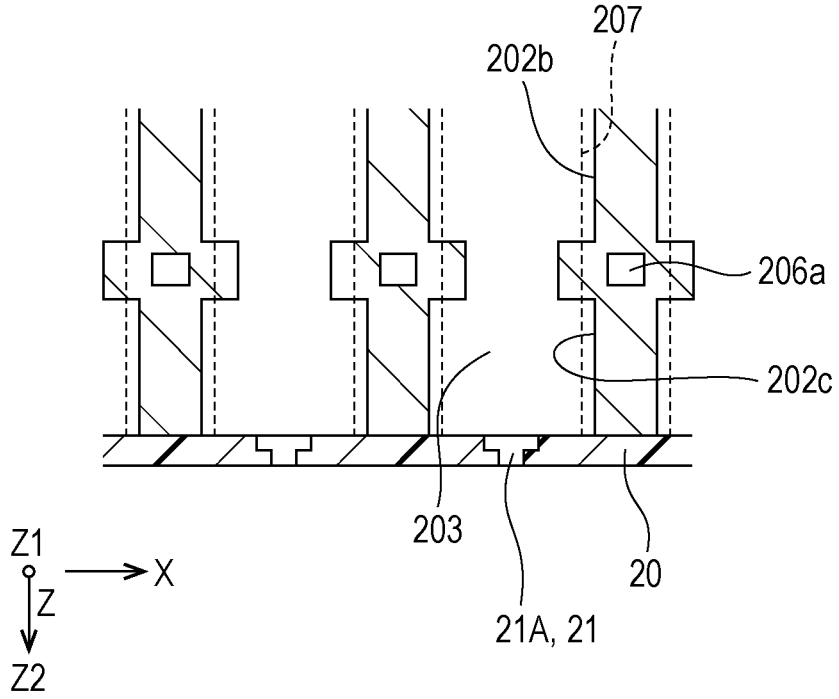
FIG. 9 is a cross-sectional view of a main part of a recording head according to Embodiment 2 of the present disclosure.

FIG. 8 is a perspective view seen from the Z2 side illustrating flow paths of an ink jet type recording head which is one example of a liquid ejecting head according to Embodiment 2 of the present disclosure. FIG. 9 is a cross-sectional view of a main part of the recording head of the embodiment taken along a line IX-IX in FIG. 6. Incidentally, the same reference signs are assigned to the same members as those in the embodiment described above, and the duplicated description will be omitted.

Similar to Embodiment 1 described above, the flow path formation substrate 10, the communication plate 15, the nozzle plate 20, the compliance substrate 49, and the case member 40 which are a flow path substrate having the first common liquid chamber 101, the second common liquid chamber 102, and a plurality of the individual flow paths 200.

In addition, the individual flow path 200 has the first individual flow path 200A and the second individual flow path 200B.

The first individual flow path 200A has the first flow path 201; the first pressure chamber 12A; the second flow path 202 which is an upstream communication path; the first nozzle 21A; the third flow path 203; the fourth flow path 204 which is a downstream communication path; and the fifth flow path 205 which is a downstream horizontal flow path.

The second individual flow path 200B has the sixth flow path 206 which is an upstream horizontal flow path; the seventh flow path 207 which is an upstream communication path; the eighth flow path 208; the second nozzle 21B; the ninth flow path 209 which is a downstream communication path; the second pressure chamber 12B; and the tenth flow path 210.

As illustrated in FIGS. 8 and 9, the second flow path 202 which is the upstream communication path of the first individual flow path 200A and the sixth flow path 206 which is the upstream horizontal flow path of the second individual flow path 200B are disposed so as to intersect each other in a plan view from the first direction X which is the side by side arrangement direction of the nozzles 21.

At least one of the second flow path 202 and the sixth flow path 206 is provided such that the width of an intersecting portion in the first direction X is narrower than the width of the other part.

Similar to Embodiment 1 described above, the sixth flow path 206 has the first narrow width portion 206*a* and the first wide width portion 206*b*. Namely, the sixth flow path 206 has the first narrow width portion 206*a* in a portion intersecting the second flow path 202.

In addition, a third narrow width portion 202*a* is provided in a portion of the second flow path 202 which intersects the sixth flow path 206, namely, a portion overlapping the sixth flow path 206 in the plan view from the first direction X, which has a width in the first direction X narrower than the width of the other part. Specifically, the second flow path 202 has a third wide width portion 202*b* that is closer to the Z1 side than the third narrow width portion 202*a* and has a width in the first direction X wider than the width of the third narrow width portion 202*a*, and a fourth wide width portion 202*c* that is closer to the Z2 side than the third narrow width portion 202*a* and has a width in the first direction X wider than the width of the third narrow width portion 202*a*.

As described above, if the second flow path 202 is provided with the third wide width portion 202*b* and the fourth wide width portion 202*c*, since it is possible to reduce the flow path resistance and the inertance of the second flow path 202, even though the first nozzles 21A are disposed at a high density, it is possible to improve the discharge characteristics of ink droplets, particularly, to increase the weight of ink droplets. In addition, since it is possible to reduce the flow path resistance and the inertance of the second flow path 202, it is possible to prevent a reduction in the amount of ink circulation from the first common liquid chamber 101 to the second common liquid chamber 102.

In addition, if the sixth flow path 206 is provided with the first wide width portion 206*b*, compared to a case where only the first narrow width portion 206*a* is provided in the sixth flow path 206, since it is possible to reduce the flow path resistance and the inertance, a shortage of ink supply from the first common liquid chamber 101 to the second pressure chamber 12B is prevented from occurring, and thus it is possible to continuously discharge ink droplets in a short period. In addition, since it is possible to reduce the flow path resistance and the inertance of the sixth flow path 206, it is possible to prevent a reduction in the amount of ink circulation from the first common liquid chamber 101 to the second common liquid chamber 102.

Similarly, the ninth flow path 209 which is the downstream communication path of the second individual flow path 200B and the fifth flow path 205 which is the downstream horizontal flow path of the first individual flow path 200A are disposed so as to intersect each other in the plan view from the first direction X which is the side by side arrangement direction of the nozzles 21.

At least one of the ninth flow path 209 and the fifth flow path 205 is provided such that the width of an intersecting portion in the first direction X is narrower than the width of the other part.

Similar to Embodiment 1 described above, the fifth flow path 205 has the second narrow width portion 205*a* and the second wide width portion 205*b*. Namely, the fifth flow path 205 has the second narrow width portion 205*a* in a portion intersecting the ninth flow path 209.

In addition, a fourth narrow width portion 209*a* is provided in a portion of the ninth flow path 209 which intersects the fifth flow path 205, namely, a portion overlapping the fifth flow path 205 in the plan view from the first direction X, which has a width in the first direction X narrower than the width of the other part. Specifically, the fifth flow path 205 has a fifth wide width portion 209*b* that is closer to the Z1 side than the fourth narrow width portion 209*a* and has a width in the first direction X wider than the width of the fourth narrow width portion 209*a*, and a sixth wide width portion 209*c* that is closer to the Z2 side than the fourth narrow width portion 209*a* and has a width in the first direction X wider than the width of the fourth narrow width portion 209*a*.

As described above, if the ninth flow path 209 is provided with the fifth wide width portion 209*b* and the sixth wide width portion 209*c*, since it is possible to reduce the flow path resistance and the inertance of the ninth flow path 209, even though the second nozzles 21B are disposed at a high density, it is possible to improve the discharge characteristics of ink droplets, particularly, to increase the weight of ink droplets. In addition, since it is possible to reduce the flow path resistance and the inertance of the ninth flow path 209, it is possible to prevent a reduction in the amount of ink circulation from the first common liquid chamber 101 to the second common liquid chamber 102.

In addition, if the second wide width portion 205*b* is provided in the fifth flow path 205, compared to a case where only the second narrow width portion 205*a* is provided in the fifth flow path 205, since it is possible to reduce the flow path resistance and the inertance, an ink supply from the second common liquid chamber 102 to the first pressure chamber 12A is prevented from becoming short, and thus it is possible to continuously discharge ink droplets in a short period. In addition, it is possible to prevent a reduction in the amount of ink circulation from the first common liquid chamber 101 to the second common liquid chamber 102 by reducing the flow path resistance and the inertance of the fifth flow path 205.

As described above, the ink jet type recording head 1 which is one example of the liquid ejecting head of the embodiment includes a flow path substrate in which a flow path is formed, and the piezoelectric actuator 300 which is an energy generating element for inducing a change in the pressure of an ink which is a liquid of the flow path. The flow path contains the first common liquid chamber 101; the second common liquid chamber 102; and the plurality of individual flow paths 200 which communicate with the first common liquid chamber 101 and the second common liquid chamber 102 and through which the liquid flows from the first common liquid chamber 101 toward the second common liquid chamber 102. The individual flow path 200 includes the nozzle 21 that communicates with the outside; the pressure chamber 12 in which a pressure change is induced by the piezoelectric actuator 300; and the second flow path 202 and the seventh flow path 207 that are upstream communication paths extending between from the nozzle 21 to the first common liquid chamber 101 in the third direction Z which is the normal direction of the nozzle surface 20*a* in which the nozzle 21 opens. The second flow path 202 and the seventh flow path 207 of the first individual flow path 200A and the second individual flow path 200B, which are the individual flow paths 200 adjacent to each other in the first direction X which is the side by side arrangement direction of the nozzles 21, have the parts which do not overlap each other in the plan view from the first direction X.

As described above, if the second flow path 202 and the seventh flow path 207 are disposed so as to have the parts which do not overlap each other in the plan view from the first direction X, it is possible to improve the rigidity of the wall between the second flow paths 202 and the rigidity of the wall between the seventh flow paths 207 which are adjacent to each other in the first direction X, and thus the deformation of the walls of the second flow path 202 and the seventh flow path 207 is prevented which is caused by a pressure fluctuation when ink droplets are discharged, and the absorption of a pressure is prevented which takes place due to the deformation of the walls of the second flow path 202 and the seventh flow path 207. Therefore, it is possible to prevent the occurrence of cross talk caused by a reduction in the rigidities of the walls.

By the way, if the second flow path 202 and the seventh flow path 207 are disposed at positions which completely overlap each other in the plan view from the first direction X, the wall between the second flow path 202 and the seventh flow path 207 is formed to be thin in the third direction Z, and thus the wall is deformed due to a fluctuation in the pressure of the ink in the second flow path 202 and the seventh flow path 207, and cross talk occurs. In addition, if the second flow path 202 and the seventh flow path 207 are disposed at positions apart from each other in the first direction X so as to enhance the rigidity of the wall between the second flow path 202 and the seventh flow path 207, the nozzles 21 are disposed at a low density in the first direction X, and the size of the flow path substrate in the first direction X is increased. As in the embodiment, if the second flow path 202 and the seventh flow path 207 are disposed such that at least parts thereof do not overlap each other in the plan view from the first direction X, even though the second flow path 202 and the seventh flow path 207 are disposed relatively close to each other in the first direction X, it is possible to prevent a reduction in the rigidity of the wall, and it is possible to prevent the density of the nozzles 21 from becoming low, and to prevent a size increase of the flow path substrate.

In addition, in the recording head 1 of the embodiment, the second individual flow path 200B, which is one of two individual flow paths 200 adjacent to each other in the first direction X which is the side by side arrangement direction, has the sixth flow path 206 that is the upstream horizontal flow path provided extending in the second direction Y which is the in-plane direction of the nozzle surface 20*a*, and intersecting, in the plan view from the first direction X, the second flow path 202 which is the upstream communication path of the first individual flow path 200A which is the other individual flow path. In at least one of the second flow path 202 and the sixth flow path 206, a portion in which the second flow path 202 and the sixth flow path 206 intersect each other has a width in the first direction X narrower than the width of the other part.

In the embodiment, the sixth flow path 206 and the second flow path 202 are provided with the first narrow width portion 206*a* and the third narrow width portion 202*a*, respectively.

As described above, if the sixth flow path 206 is provided with the first narrow width portion 206*a* and the first wide width portion 206*b*, since it is possible to reduce the flow path resistance and the inertance of the sixth flow path 206, poor ink supply from the first common liquid chamber 101 to the second pressure chamber 12B is prevented, and thus it is possible to continuously discharge ink droplets in a short period. In addition, since it is possible to reduce the flow path resistance and the inertance of the sixth flow path 206, it is possible to prevent a reduction in the amount of ink circulation from the first common liquid chamber 101 to the second common liquid chamber 102.

In addition, if the second flow path 202 is provided with the third narrow width portion 202*a*, the third wide width portion 202*b*, and the fourth wide width portion 202*c*, since it is possible to reduce the flow path resistance and the inertance of the second flow path 202, even though the first nozzles 21A are disposed at a high density, it is possible to improve the discharge characteristics of ink droplets, particularly, to increase the weight of ink droplets. In addition, since it is possible to reduce the flow path resistance and the inertance of the second flow path 202, it is possible to prevent a reduction in the amount of ink circulation from the first common liquid chamber 101 to the second common liquid chamber 102.

Naturally, the third narrow width portion 202*a* may be provided only in the second flow path 202, and the sixth flow path 206 may be provided such that the width thereof in the first direction X remains the same in the second direction Y.

In addition, in the recording head 1 of the embodiment, the individual flow path 200 further has the fourth flow path 204 and the ninth flow path 209 that are the downstream communication paths extending between from the nozzle 21 to the second common liquid chamber 102 in the third direction Z which is the normal direction of the nozzle surface 20*a*. The fourth flow path 204 and the ninth flow path 209 of the first individual flow path 200A and the second individual flow path 200B, which are the individual flow paths adjacent to each other in the first direction X which is the side by side arrangement direction, have the parts which do not overlap each other in the plan view from the first direction X.

As described above, if the fourth flow path 204 and the ninth flow path 209 are disposed so as to have the parts which do not overlap each other in the plan view from the first direction X, it is possible to improve the rigidity of the wall between the fourth flow paths 204 and the rigidity of the wall between the ninth flow paths 209 which are adjacent to each other in the first direction X, and thus the deformation of the walls of the fourth flow path 204 and the ninth flow path 209 is prevented which is caused by a pressure fluctuation when ink droplets are discharged, and the absorption of a pressure is prevented which takes place due to the deformation of the walls of the fourth flow path 204 and the ninth flow path 209. Therefore, it is possible to prevent the occurrence of cross talk caused by a reduction in the rigidities of the walls.

By the way, if the fourth flow path 204 and the ninth flow path 209 are disposed at positions which completely overlap each other in the plan view from the first direction X, the wall between the fourth flow path 204 and the ninth flow path 209 is formed to be thin in the third direction Z, and thus the wall is deformed due to a fluctuation in the pressure of the ink in the fourth flow path 204 and the ninth flow path 209, and cross talk occurs. In addition, if the fourth flow path 204 and the ninth flow path 209 are disposed at positions apart from each other in the first direction X so as to enhance the rigidity of the wall between the fourth flow path 204 and the ninth flow path 209, the nozzles 21 are disposed at a low density in the first direction X, and the size of the flow path substrate in the first direction X is increased. As in the embodiment, if the fourth flow path 204 and the ninth flow path 209 are disposed such that at least parts thereof do not overlap each other in the plan view from the first direction X, even though the fourth flow path 204 and the ninth flow path 209 are disposed relatively close to each other in the first direction X, it is possible to prevent a reduction in the rigidity of the wall, and it is possible to prevent the density of the nozzles 21 from becoming low, and to prevent a size increase of the flow path substrate.

In addition, in the recording head 1 of the embodiment, the second individual flow path 200B, which is one of two individual flow paths 200 adjacent to each other in the first direction X which is the side by side arrangement direction, has the ninth flow path 209 that is the downstream horizontal flow path provided extending in the second direction Y which is the in-plane direction of the nozzle surface 20*a*, and intersecting, in the plan view from the first direction X, the fifth flow path 205 which is the downstream communication path of the first individual flow path 200A which is the other individual flow path. In at least one of the fifth flow path 205 and the ninth flow path 209, a portion in which the fifth flow path 205 and the ninth flow path 209 intersect each other has a width in the first direction X narrower than the width of the other part.

In the embodiment, the fifth flow path 205 and the ninth flow path 209 are provided with the second narrow width portion 205*a* and the fourth narrow width portion 209*a*, respectively.

As described above, if the fifth flow path 205 is provided with the second narrow width portion 205*a* and the second wide width portion 205*b*, since it is possible to reduce the flow path resistance and the inertance of the fifth flow path 205, it is possible to prevent poor ink supply from the second common liquid chamber 102 to the first pressure chamber 12A, and to continuously discharge ink droplets in a short period. In addition, it is possible to prevent a reduction in the amount of ink circulation from the first common liquid chamber 101 to the second common liquid chamber 102 by reducing the flow path resistance and the inertance of the fifth flow path 205.

In addition, if the ninth flow path 209 is provided with the fourth narrow width portion 209*a*, the fifth wide width portion 209*b*, and the sixth wide width portion 209*c*, since it is possible to reduce the flow path resistance and the inertance of the ninth flow path 209, even though the second nozzles 21B are disposed at a high density, it is possible to improve the discharge characteristics of ink droplets, particularly, to increase the weight of ink droplets. In addition, since it is possible to reduce the flow path resistance and the inertance of the ninth flow path 209, it is possible to prevent a reduction in the amount of ink circulation from the first common liquid chamber 101 to the second common liquid chamber 102.

Naturally, the fourth narrow width portion 209*a* may be provided only in the ninth flow path 209, and the third flow path 203 may be provided such that the width thereof in the first direction X remains the same in the second direction Y.

Other Embodiments

The embodiments of the present disclosure are described above, but basic configurations of the present disclosure are not limited to the configurations described above.

In addition, in each of the embodiments described above, a configuration where the first nozzle 21A and the second nozzle 21B are disposed at different positions in the second direction Y is exemplified, but the present disclosure is not specifically limited to the configuration. The first nozzle 21A and the second nozzle 21B may be provided at the same position in the second direction Y, namely, may be provided such that the nozzles 21 are disposed on a straight line along the first direction X. Namely, in order to provide the first nozzle 21A and the second nozzle 21B at the same position in the second direction Y, the first nozzle 21A may be provided at a position in the middle of the third flow path 203 so as to communicate therewith, and the second nozzle 21B may be provided at a position in the middle of the eighth flow path 208 so as to communicate therewith. Naturally, even though the first nozzle 21A and the second nozzle 21B are disposed at different positions in the second direction Y, the first nozzle 21A may be provided at a position in the middle of the third flow path 203 so as to communicate therewith, and the second nozzle 21B may be provided at a position in the middle of the eighth flow path 208 so as to communicate therewith.

As described above, if the first nozzle 21A and the second nozzle 21B are disposed at relatively close positions in the second direction Y, turbulent flows generated by ink droplets discharged from the first nozzle 21A and the second nozzle 21B are prevented from affecting each other, and thus it is possible to prevent a deviation in the flying direction of the ink droplets which is caused by the turbulent flows. In addition, if the plurality of nozzles 21 are disposed on a straight line in the first direction X, it is not necessary to adjust the timing of discharging ink droplets from the nozzles 21 so as for the timings to deviate from each other, and it is possible to simplify control of the drive of the piezoelectric actuator 300.

In addition, in each of the embodiments described above, a configuration where one row of the first pressure chamber 12A and one row of the second pressure chamber 12B, namely, two rows in total are provided is exemplified, but the present disclosure is not limited to the configuration. Two or more rows of the first pressure chambers 12A may be provided, and two or more rows of the second pressure chambers 12B may be provided.

In addition, in each of the embodiments described above, a configuration where one nozzle 21 and one pressure chamber 12 are provided for each of the individual flow paths 200 is exemplified, but the number of the nozzles 21 and the number of the pressure chambers 12 are not specifically limited. Two or more plurality of the nozzles 21 may be provided for one pressure chamber 12, and two or more plurality of the pressure chambers 12 may be provided for one nozzle 21. However, ink droplets are simultaneously discharged in one discharge period from the nozzles 21 provided in one individual flow path 200. Namely, even though the plurality of nozzles 21 are provided in one individual flow path 200, only either of a discharge mode in which ink droplets are simultaneously discharged from the plurality of nozzles 21 and a non-discharge mode in which ink droplets are not simultaneously discharged therefrom is performed.

In addition, in each of the embodiments described above, the flow path substrate has the flow path formation substrate 10, the communication plate 15, the nozzle plate 20, the compliance substrate 49, the case member 40, and the like, but the present disclosure is not specifically limited to the configuration. The flow path substrate may be one piece of substrate, or may be formed by laminating two or more plurality of pieces of substrates on top of each other. For example, the flow path substrate may contain the flow path formation substrate 10 and the nozzle plate 20, and may not contain the communication plate 15, the compliance substrate 49, and the case member 40. In addition, one pressure chamber 12 may be formed by a plurality of the flow path formation substrates 10, and the pressure chamber 12, the first common liquid chamber 101, and the second common liquid chamber 102 may be formed in the flow path formation substrate 10.

In addition, in each of the embodiments described above, the piezoelectric actuator 300 which is a thin film type is described as an energy generating element that induces a pressure change in the pressure chamber 12, but the present disclosure is not specifically limited to the type. It is possible to use, for example, a thick film type piezoelectric actuator formed by a method such as pasting green sheets together, or a longitudinal vibration type piezoelectric actuator in which a piezoelectric material and an electrode forming material are alternately laminated on top of each other and which expands and contracts in an axial direction. In addition, as an energy generating element, it is possible to use, for example, an actuator in which a heating element is disposed in a pressure chamber and discharges liquid droplets from a nozzle by means of bubbles formed by heat of the heating element, or a so-called electrostatic actuator that discharges liquid droplets from a nozzle opening by generating static electricity between a vibrating plate and an electrode, and deforming the vibrating plate with the static electricity.

Herein, one example of an ink jet type recording apparatus which is one example of the liquid ejecting apparatus of the embodiment will be described with reference to FIG. 10. Incidentally, FIG. 10 is a view illustrating a schematic configuration of the ink jet type recording apparatus of the present disclosure.

Figure 10:
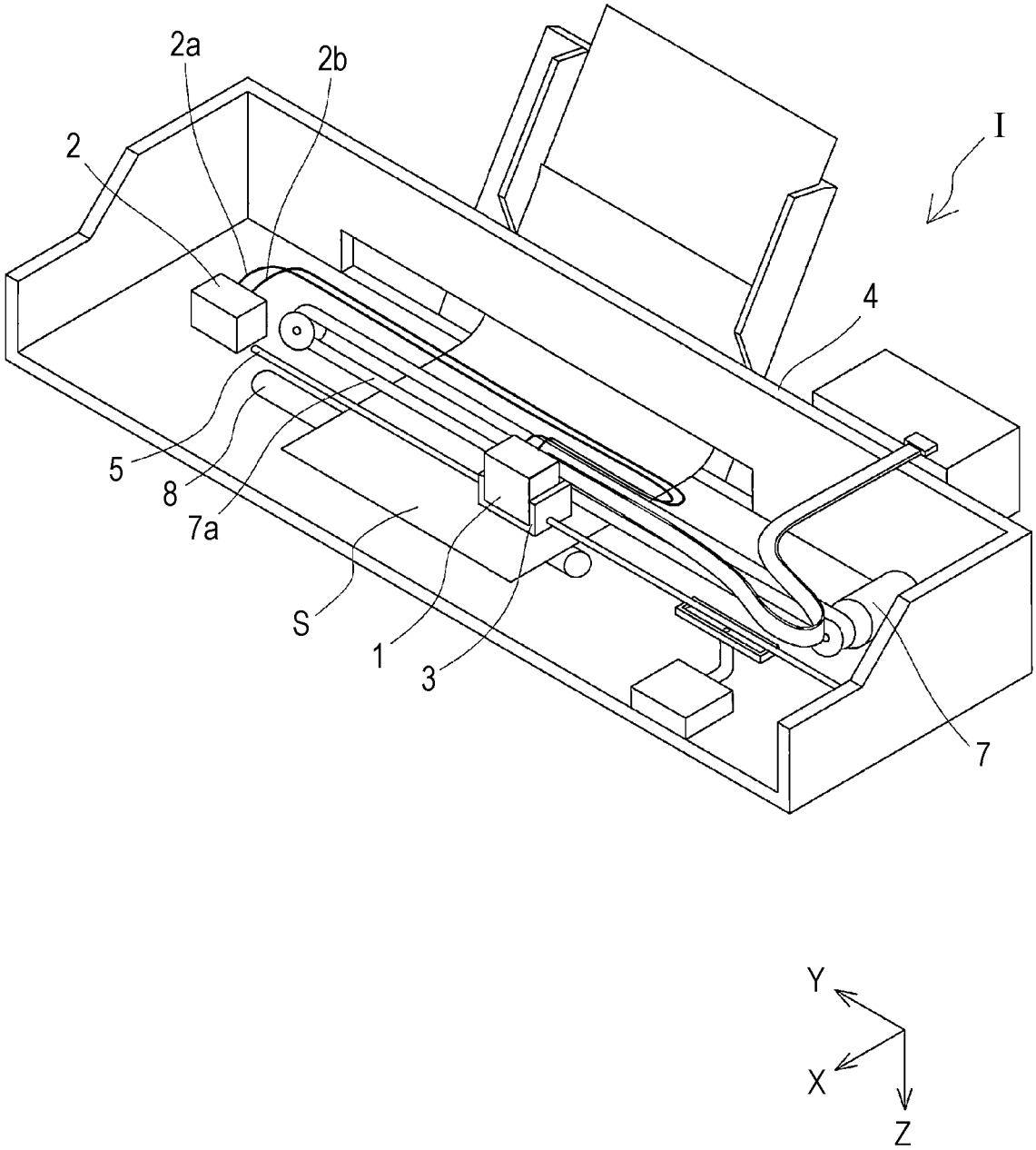
FIG. 10 is a view illustrating a schematic configuration of a recording apparatus according to an embodiment of the present disclosure.

As illustrated in FIG. 10, in an ink jet type recording apparatus I which is one example of the liquid ejecting apparatus, a plurality of the recording heads 1 are mounted on a carriage 3. The carriage 3 on which the recording heads 1 are mounted are provided on a carriage shaft 5 attached to an apparatus main body 4, so as to be movable in an axial direction. In the embodiment, a movement direction of the carriage 3 is the second direction Y.

In addition, the apparatus main body 4 is provided with a tank 2 which is a storage unit that stores an ink as a liquid. The tank 2 is coupled to the recording heads 1 via a supply pipe 2*a* such as a tube, and the ink from the tank 2 is supplied to the recording heads 1 via the supply pipe 2*a*. In addition, the recording heads 1 are coupled to the tank 2 via an outlet pipe 2*b* such as a tube, and the ink flowing out from the recording heads 1 returns to the tank 2 via the outlet pipe 2*b*, namely, so-called circulation is performed. Incidentally, a plurality of the tanks 2 may be provided.

If a drive force of a drive motor 7 is transmitted to the carriage 3 via a plurality of gears (not illustrated) and a timing belt 7*a*, the carriage 3 on which the recording heads 1 are mounted move along the carriage shaft 5. On the one hand, a transport roller 8 as a transport unit is provided in the apparatus main body 4, and a recorded sheet S such as paper which is an ejection target medium is transported by the transport roller 8. Incidentally, the transport unit which transports the recorded sheet S is not limited to the transport roller 8, and may be a belt, a drum, or the like. In the embodiment, a transport direction of the recorded sheet S is the first direction X.

Incidentally, in the ink jet type recording apparatus I described above, a configuration where the recording heads 1 are mounted on the carriage 3 and move in a main scanning direction is exemplified, but the present disclosure is not specifically limited to the configuration. The present disclosure can be applied, for example, also to a so-called line type recording apparatus that performs printing only by moving the recorded sheet S such as paper in an auxiliary scanning direction in a state where the recording heads 1 are fixed.

In addition, if as in Embodiment 2 described above, the ink circulates between the tank 2 and the recording heads 1, an outlet pipe by which the tank 2 is coupled to the recording heads 1 may be provided, and the ink from the recording heads 1 may return to the tank 2 via the outlet pipe.

Incidentally, in each of the embodiments, the ink jet type recording head and the ink jet type recording apparatus are exemplarily described as one example of the liquid ejecting head and one example of the liquid ejecting apparatus, respectively. The present disclosure is intended for a wide range of liquid ejecting heads and liquid ejecting apparatuses in general, and naturally, can be applied also to liquid ejecting heads or liquid ejecting apparatuses which eject liquids other than an ink. Examples of other liquid ejecting heads include various recording heads used in image recording apparatuses such as a printer, a color material ejecting head used to manufacture color filters such as a liquid crystal display, an electrode material ejecting head used to form electrodes such as an organic EL display and a field emission display (FED), a bioorganic matter ejecting head used to manufacture biochips. The present disclosure can be applied also to liquid ejecting apparatuses including the liquid ejecting heads.

What is claimed is:

1. A liquid ejecting head comprising:

first and second individual flow paths arranged side by side along a first direction;

a first nozzle communicating with the first individual flow path;

a second nozzle communicating with the second individual flow path;

a first pressure chamber associated with the first individual flow path;

a second pressure chamber associated with the second individual flow path;

a first common liquid chamber coupled to one end of the first and second individual flow paths; and a second common liquid chamber coupled to the other ends of the first and second individual flow paths, wherein the first and second nozzles have openings in a nozzle surface having a second direction as a normal direction, the first individual flow path has a first upstream communication path extending between the first nozzle and the first common liquid chamber along the second direction, the second individual flow path has a second upstream communication path extending between the second nozzle and the first common liquid chamber along the second direction, the first upstream communication path is provided between the first pressure chamber and the second common liquid chamber, the second upstream communication path is provided between the second pressure chamber and the first common liquid chamber, the first upstream communication path and the second upstream communication path have parts which do not overlap each other when seen along the first direction, the first individual flow path has a first downstream communication path extending between the first nozzle and the second common liquid chamber along the second direction, the second individual flow path has a second downstream communication path extending between the second nozzle and the second common liquid chamber along the second direction, and the first downstream communication path and the second downstream communication path have parts which do not overlap each other when seen along the first direction.

2. The liquid ejecting head according to claim 1, wherein the second individual flow path has a first portion of the second individual flow path extending along a direction that intersects the second direction, and when a region in which the first downstream communication path and the first portion of the second individual flow path intersect each other when seen from the first direction is referred to as a first region, the first downstream communication path has a width in the first region in the first direction, which is narrower than a width of the first downstream communication path in another region of the first downstream communication path.

3. The liquid ejecting head according to claim 1, wherein the second individual flow path has a first portion of the second individual flow path extending along a direction that intersects the second direction, and when a region in which the first downstream communication path and the first portion of the second individual flow path intersect each other when seen from the first direction is referred to as a first region, the first portion has a width in the first region in the first direction, which is narrower than a width in a second portion of the second individual flow path upstream of the first portion.

4. A liquid ejecting apparatus comprising:

the liquid ejecting head according to claim 1.

5. The liquid ejecting head according to claim 1, wherein the first pressure chamber and the second pressure chamber extend along a third direction crossing the first direction and the second direction.

6. A liquid ejecting head comprising:

first and second individual flow paths arranged side by side along a first direction;

a first nozzle communicating with the first individual flow path;

a second nozzle communicating with the second individual flow path;

a first pressure chamber associated with the first individual flow path;

a second pressure chamber associated with the second individual flow path;

a first common liquid chamber coupled to one end of the first and second individual flow paths; and a second common liquid chamber coupled to the other ends of the first and second individual flow paths, wherein the first and second nozzles have openings in a nozzle surface having a second direction as a normal direction, the first individual flow path has a first upstream communication path extending between the first nozzle and the first common liquid chamber along the second direction, the second individual flow path has a second upstream communication path extending between the second nozzle and the first common liquid chamber along the second direction, the first upstream communication path is provided between the first pressure chamber and the second common liquid chamber, the second upstream communication path is provided between the second pressure chamber and the first common liquid chamber, the first upstream communication path and the second upstream communication path have parts which do not overlap each other when seen along the first direction, the second individual flow path has a first portion of the second individual flow path extending along a direction that intersects the second direction, and when a region in which the first upstream communication path and the first portion of the second individual flow path intersect each other when seen from the first direction is referred to as a first region, the first upstream communication path has a width in the first region in the first direction, which is narrower than a width of the first upstream communication path in another region of the first upstream communication path.

7. A liquid ejecting head comprising:

first and second individual flow paths arranged side by side along a first direction;

a first nozzle communicating with the first individual flow path;

a second nozzle communicating with the second individual flow path;

a first pressure chamber associated with the first individual flow path;

a second pressure chamber associated with the second individual flow path;

a first common liquid chamber coupled to one end of the first and second individual flow paths; and a second common liquid chamber coupled to the other ends of the first and second individual flow paths, wherein the first and second nozzles have openings in a nozzle surface having a second direction as a normal direction, the first individual flow path has a first upstream communication path extending between the first nozzle and the first common liquid chamber along the second direction, the second individual flow path has a second upstream communication path extending between the second nozzle and the first common liquid chamber along the second direction, the first upstream communication path is provided between the first pressure chamber and the second common liquid chamber, the second upstream communication path is provided between the second pressure chamber and the first common liquid chamber, the first upstream communication path and the second upstream communication path have parts which do not overlap each other when seen along the first direction, the second individual flow path has a first portion of the second individual flow path extending along a direction that intersects the second direction, and when a region in which the first upstream communication path and the first portion of the second individual flow path intersect each other when seen from the first direction is referred to as a first region, the first portion has a width in the first region in the first direction, which is narrower than a width in a second portion of the second individual flow path upstream of the first portion.

* * * * *